US012752998B2

(12) United States Patent
Tandhasetti

(10) Patent No.: US 12,752,998 B2
(45) Date of Patent: Oct. 6, 2026

(54) SYSTEMS METHODS DEVICES ASSEMBLIES AND APPARATUSES FOR VACUUMED STORAGE

(71) Applicant: Paul Tandhasetti, Dania Beach, FL (US)

(72) Inventor: Paul Tandhasetti, Dania Beach, FL (US)

( * ) Notice: Subject to any disclaimer, the term of this patent is extended or adjusted under 35 U.S.C. 154(b) by 0 days.

(21) Appl. No.: 18/751,221

(22) Filed: Jun. 22, 2024

(65) Prior Publication Data

US 2025/0388381 A1 Dec. 25, 2025

(51) Int. Cl.
*B65D 81/20* (2006.01)

(52) U.S. Cl.
CPC ..... *B65D 81/2015* (2013.01)

(58) Field of Classification Search
CPC ..... B65D 81/2015
USPC ..... 141/65
See application file for complete search history.

(56) References Cited

U.S. PATENT DOCUMENTS 11,884,471 B1 * 1/2024 Sanders ..... B65B 7/28
2002/0094277 A1 * 7/2002 Gaudet ..... F04D 15/0066 417/44.1
2018/0093814 A1 * 4/2018 Espinosa ..... A23B 2/53
2019/0009967 A1 * 1/2019 Lung ..... B65D 25/54
2023/0312151 A1 * 10/2023 Lobisser ..... B65B 25/001

FOREIGN PATENT DOCUMENTS

CN 216995833 U * 7/2022

OTHER PUBLICATIONS

CN216995833U—English Translation (Year: 2022).*

* cited by examiner

*Primary Examiner* — Christopher M Afful

(57) ABSTRACT

Disclosed is a device for food or other perishables preservation, wherein food or perishables are stored within an at least partially vacuumed environment. A device assembly includes a container and a cover, wherein a pressure monitoring and regulation controller is adapted to operate a gas pumping mechanism to maintain a target sub-atmospheric gas pressure level within the container. The gas pumping mechanism may be in the form of a battery powered air pump, driven by the controller, which includes a container pressure sensor adapted to sense air pressure in the container when the lid is closed over the container opening. The controller is configured to stop pumping the air from the container once a target pressure level in the container is attained.

17 Claims, 19 Drawing Sheets

SYSTEMS METHODS DEVICES ASSEMBLIES AND APPARATUSES FOR VACUUMED STORAGE

FIELD OF THE INVENTION

The present invention generally relates to the field of food and perishables storage. More specifically, the present invention relates to systems, methods, devices, assemblies and apparatuses for vacuumed storage.

BACKGROUND

Various foods and perishables are often bought and then used over a period of time, necessitating storage in a manner preventing their degradation and preserving their qualities. Some of the main factors that may affect the freshness and quality of such products are light, air and moisture.

Cannabis for example, is traditionally stored using a wide spectrum of solutions, depending on the specific type of stored substance, its freshness/moisture/ripeness levels, and/or habits of the consumer such as their consumption rate of the product. Storage options can range from plastic baggies to plastic containers to metal containers to airtight glass containers.

The main factors affecting foods and perishables—light, air, and moisture—are known to also degrade the quality of cannabis and cannabis products. Light—UV light will degrade the quality of cannabis over time. Cannabis stored without light can last a long time and has minimal degradation. Air—atmospheric oxygen reacts with the cannabis and oxidizes it over time. Air also facilitates the growth of bacteria that may ruin cannabis and render it non consumable. Lastly, contact with air reduces the aroma and flavor of herbs and spices such as cannabis. Moisture—humidity can cause cannabis to grow mold.

There are numerous laws in various jurisdictions requiring that cannabis and cannabis products be stored in child-resistant packaging (CRP). CRP is packaging that is designed to be difficult for children to open.

There remains a need, in the field of food and perishables storage, for solutions facilitating the storage of foods, herbs, or other perishables, while preserving their qualities, delaying their degradation for extended time periods and preventing their unauthorized access.

SUMMARY OF THE INVENTION

Embodiments of the present invention relate to systems, methods, devices, assemblies, and apparatuses for food or other perishables preservation by storing the food or perishables within an at least partially vacuumed environment. According to some embodiments, there may be provided a device assembly, including a container and a cover, wherein the assembly includes a pressure monitoring and regulation controller adapted to maintain a target sub-atmospheric gas pressure level within the container. The device assembly may further include, according to embodiments of the present invention, a pressure sensor, a cover engagement sensor, an air pump, a vacuum release mechanism, and a power source such as a rechargeable battery.

The pressure monitoring and regulation controller may monitor pressure level indicative values or signals collected by the pressure sensor from within the container, to trigger the operation of the air pump upon pressure level within the container rising (i.e. vacuum level dropping) above a threshold value or combination of values. The pressure monitoring and regulation controller may further monitor pressure level indicative values or signals collected by the pressure sensor from within the container, to halt the operation of the air pump upon pressure level within the container dropping (i.e. vacuum level rising) below a threshold value or combination of values.

According to some embodiments, air removed by the air pump from within the container being vacuumed may be channeled through a filter, prior to its discharging to the container's outer surrounding, to trap and minimize odors originating from the food or perishables stored in the container, from being released to the environment.

According to further embodiments, opening the container once a cover is placed and vacuum is achieved, may require releasing the vacuum. There may be provided a vacuum, or 'airlock', release mechanism on the cover which when activated/pressed allows air to flow through it and into the container, while optionally, also suppressing or halting air pumping by the controller managed pump. Various vacuum/pressure release mechanisms may be used in conjunction with the present invention.

Further embodiments of the present invention may include a digital/electric vacuum release mechanism connected to the controller and/or to a processor. Opening the cover according to this embodiment may require pressing of an electric actuator, possibly the entering of a PIN, code, password, one time password (OTP), combination and/or biometric and, optionally a multi-factor authentication step such as receiving an authentication request online or to a mobile device application.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings:

Figure 1A:
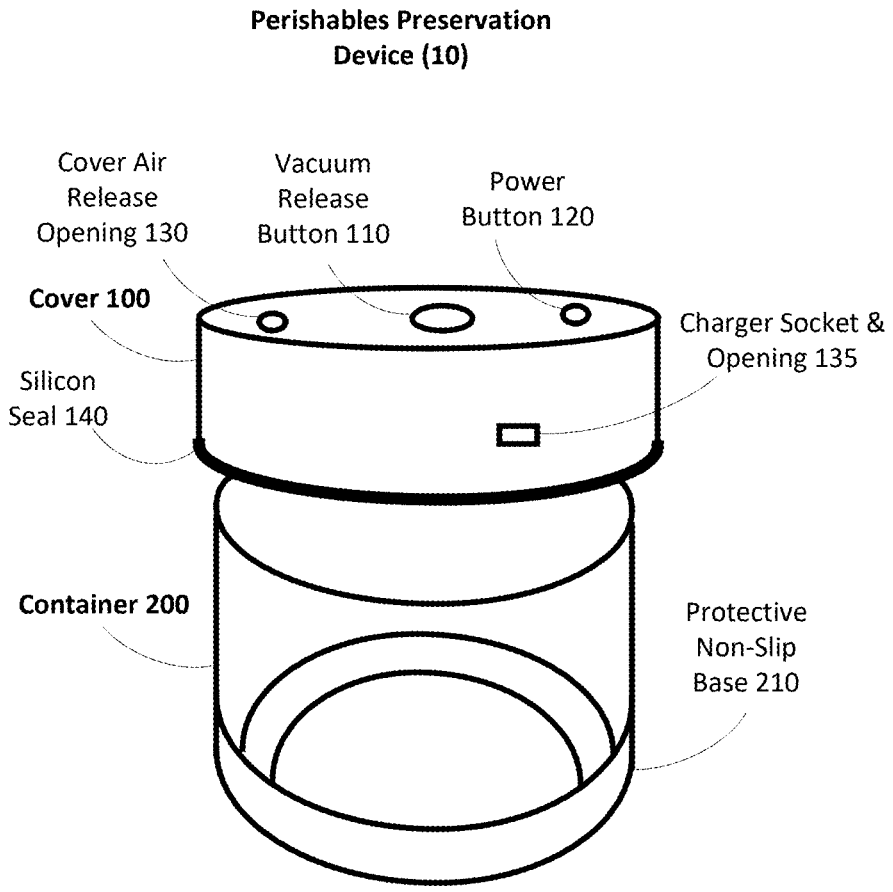
FIG. 1A is a diagram of an exemplary device for perishables preservation, in accordance with some embodiments.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals or element labeling may be repeated among the figures to indicate corresponding or analogous elements.

DETAILED DESCRIPTION

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Unless specifically stated otherwise, as apparent from the following discussions, it is appreciated that throughout the specification discussions utilizing terms such as "processing", "computing", "calculating", "determining", or the like, may refer to the action and/or processes of a computer, computing system, computerized mobile device, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In addition, throughout the specification discussions utilizing terms such as "storing", "hosting", "caching", "saving", or the like, may refer to the action and/or processes of 'writing' and 'keeping' digital information on a computer or computing system, or similar electronic computing device, and may be interchangeably used. The term "plurality" may be used throughout the specification to describe two or more components, devices, elements, parameters and the like.

Functions, operations, components and/or features described herein with reference to one or more embodiments, may be combined with, or may be utilized in combination with, one or more other functions, operations, components and/or features described herein with reference to one or more other embodiments.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "includes", "including", "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present disclosure is to be considered as an exemplification of the invention, and as such, is not intended to limit the invention to the specific embodiments illustrated by the figures or description below.

Embodiments of the present invention relate to systems, methods, devices, assemblies and apparatuses for food or other perishables preservation by storing the food or perishables within an at least partially vacuumed environment. According to some embodiments, there may be provided a device assembly, including a container and a cover, wherein the assembly includes a pressure monitoring and regulation controller and/or processor adapted to maintain a target sub-atmospheric gas pressure level within the container. The device assembly may further include, according to embodiments of the present invention, a pressure sensor, a cover engagement sensor, an air pump, a vacuum release mechanism, a permanent or replaceable air filter, an interior light and a power source such as a rechargeable battery.

The pressure monitoring and regulation controller and/or processor (referred to herein as 'controller' or 'controller/processor' interchangeably) may monitor pressure level indicative values or signals collected by the pressure sensor from within the container, to trigger the operation of the air pump upon pressure level within the container rising (i.e. vacuum level dropping) above a threshold value or combination of values. The pressure monitoring and regulation controller may further monitor pressure level indicative values or signals collected by the pressure sensor from within the container, to halt the operation of the air pump upon pressure level within the container dropping (i.e. vacuum level rising) below a threshold value or combination of values.

According to some embodiments, the aspired vacuum level (i.e. how low is the pressure) within the container may be adjusted by the user through a device user interface, or a mobile computerized device application associated with the device. The controller may be accordingly set/programmed to maintain different low-pressure levels, based on the user elected/entered values, using the pump.

The cover engagement sensor may indicate/signal to the pressure monitoring and regulation controller of the opening, and closing, of the container assembly's cover. The controller may, in response, halt the operation of the air pump and vacuum generation within the container upon indication of it being opened (cover unscrewed/removed) and, reinitiate the operation of the air pump and vacuum generation within the container upon indication of it being closed (cover screwed/placed). A cover engagement sensor, in accordance with some embodiments, may for example take the form of a physical, magnetic, or electric micro-switch, integrated into the closing/overlapping areas/sections of the cover and/or the container.

According to some embodiments, air removed by the air pump from within the container being vacuumed may be channeled through one or more, optionally replaceable, filters, prior to its discharging to the container's outer surrounding, to trap and minimize odors originating from the food or perishables stored in the container, from being released to the environment.

A filter, in accordance with embodiments of the present invention, may include one or more filtering layers, such as carbon filter layers, through which air removed from the container is channeled. The filter may, for example, be integrated into the container's cover, positioned at/across its bottom side, and structured to, at least partially, cover the container's top opening—such that air pumped out of the container by the air pump is pulled through the filter, prior to its traveling into an interior space of the cover and following release to the outside environment.

A filtering valve, in accordance with some embodiments, may operate in concert with the filter to further mitigate the release of odors when container air is discharged as part of vacuum generation. The valve may include a filter core having/retaining a filtering medium, such as a high-density cotton element, at the path of the air being pumped out of the container.

According to further embodiments, opening the container once a cover is placed and vacuum is achieved, may require releasing the vacuum. There may be provided a vacuum, or 'airlock', release mechanism on the cover which when activated/pressed allows air to flow through it and into the container, while optionally, also suppressing or halting air pumping by the controller managed pump. Various vacuum/pressure release mechanisms may be used in conjunction with the present invention.

One such simple release mechanism may employ a combination of a mechanical spring biasing piston whose sealing edge surface engages with a cylinder-shaped opening within in the lid when the piston is spring biased shut, and which breaks the seal engagement when a user presses on an outwardly protruding/showing portion of the piston. The piston with the cylinder and their respective seals may be arranged such that a vacuum inside of the container may also bias the piston closed.

Further embodiments of the present invention may include a digital/electric vacuum release mechanism connected to the controller. Opening the cover according to this embodiment may require pressing/engaging of an electric actuator, possibly the entering of a PIN, code, combination, password, one time password (OTP) and/or biometric and, may optionally implement a multi-factor authentication step such as receiving an authentication request online or to a mobile device application. An OTP, in accordance with embodiments, may be a time-synchronized OTP utilizing an internal device clock that is synchronized with a system server, a Hash-chains based OTP, and/or a Challenge-response OTP.

A Hash-chains based OTP, in accordance with embodiments, may be generated using a one-way mathematical function. A serial number may be utilized, optionally in combination with a unique key, to generate a set number (e.g. 500), or an infinite number, of passcodes, based on an algorithm; for example, each password may be built off a combination of the key(s) (e.g. the device serial number and the unique key) and the previous OTP generated. OTPs may accordingly be centrally generated and allocated based on received requests and then distributed to users of the devices. Hash-chains based generated OTPs may for example be good for one, or a predefined number, of uses; and, may have no time limit/expiration.

A unique key, in accordance with embodiments, may be a randomly selected/generated value (e.g. between 1-2,000) that is assigned to each container device. A listing of container devices' serial numbers and their respective unique keys may be intermittently received (e.g. from the manufacturer) and registered by a system server.

According to some embodiments, in order to keep track of each OTP generated/used, the container device may intermittently sync back to a system server, via a mobile device application communicatively associated therewith, to update that a specific OTP generated and issued, has been used by the container device controller.

According to some embodiments, a predetermined number of generated passwords/PINs may be loaded onto each container device. A listing of each device and its associated set of passwords/PINs may be kept on a system server; and may be verified upon device user entry/request.

According to some embodiments, a mobile device container application may be used to control the container device's functionalities and/or to reset its password/PIN—needed for opening and removing the container's cover. According to further embodiments, an OTP as described herein may be used as a password/PIN reset tool, wherein the OTP is centrally generated by a system server and provided to the user, for example, over the phone. The provided OTP may then be used to initiate a vacuum release cycle and open the device cover once, while the opening of the device cover unlocks an option for the user to reset his password/PIN from the container device's user interface and/or to sync/associate/resync/reassociate their mobile device container application with it.

A multi-factor authentication step or scheme, in accordance with embodiments, may demand receipt of both a PIN, code, combination, password, one time password (OTP) and/or biometric, entered through a container assembly device's user interface, along with, a PIN, code, combination, password, one time password (OTP) and/or biometric, relayed from an associated user mobile device application—to trigger a vacuum release cycle.

A multi-factor authentication step or scheme, in accordance with embodiments, may include a One Time Password (OTP) based authentication, wherein the password or code relayed from a user mobile device application is generated by an authenticator application, optionally of a third party, installed on the mobile device. The generated and relayed OTP may be a time limited password, wherein the container device controller is configured to only trigger the vacuum release mechanism, factoring a given generated password, for a predetermined period following to the issuance of that password by the authenticator application.

A device assembly, according to some embodiments, may further include a separator/divider insertable component for partitioning the container's internal space to store multiple kinds or types of perishables separately and distinctly.

A separator/divider may for example consist of two or more square or rectangular partitions of a substantially same size, intersecting and connected to each other at their center lines. The partitions may be sized to match the internal diameter of a round device assembly's container, such that when inserted into the container the divider partitions vertically partition its space to form multiple separate sector-shaped vertical spaces within the container. The divider may be at least partially made of a soft or insulating material, Silicon for example, to facilitate its secure fit within the container and to act as a seal between the inner side of the container's vertical wall(s) and the edges of the divider's partitions.

According to some embodiments, the device cover may include, for example on its top, a physical (e.g. erasable marking surface) or a digital (e.g. a digital display and user interface) labels presentation, divided into sectors at positions and/or shapes corresponding to those created by the divider/separator within the container's space. The cover presentation may be utilized to input and present content labels, at presentation sectors positions/labels corresponding-to/labelled-similarly-as internal space sectors of a partitioned device container, thereby identifying the type or kind of perishable stored within each of the container's sectors.

A container of a device assembly, in accordance with some embodiments, may be made of a transparent material, such as clear glass or plastic, or of a partially transparent material, such as dark glass. According to further embodiments, a dark glass device assembly container may be at least partially made of Amethyst glass. A container of a device assembly, in accordance with some embodiments, may be structured to have low height-to-width proportion. For example, the height of a round container may be equal to, or lesser than, half of that container's horizontal diameter.

According to some embodiments, the container assembly may include a supplementary chamber, contained within or adjacent to the container. The supplementary chamber may include a separate closable opening to access food, or perishables stored within it, without accessing the vacuumed, main, container. For example, a small (e.g. daily) amount of food or perishables stored in the vacuumed container may be moved to the supplementary chamber and repeatedly accessed without releasing and losing the vacuum preserved in the main container. Accordingly, the number of vacuum generation cycles for a given period may be minimized, lowering battery power consumption.

The supplementary chamber, in accordance with embodiments, may be structured as an access pass/channel to the vacuumed main chamber, through which food or perishables stored in the vacuumed main container may be accessed and removed. The supplementary chamber may include a first door and a second, opposite, door, such that: (1) upon a first change in relative orientation (e.g. partial turn) between the container and the chamber a first door—between the container and chamber—is opened, facilitating the movement of container stored food or perishables into the chamber; and (2) upon a second change in relative orientation (e.g. an additional partial turn) between the container and the chamber (a) the first door closes and (b) a second door—between the chamber and the outside environment—is opened, enabling access of chamber stored food or perishables.

A device assembly for perishables preservation, in accordance with some embodiments, may further include: a digital display, an interior container light, a reset pin to reset operational device settings or passwords, a movement sensor and alarm, a mobile device application proximity alarm, container temperature and humidity sensors and alarms, and/or any other perishables preservation or device content management facilitating or assisting components.

A device assembly system for perishables preservation, in accordance with some embodiments, may include moisture controlling packs or elements including desiccant, to be placed within the container to lower humidity and assist perishables preservation. According to some embodiments, the device container, cover, and/or divider, may include a moisture controlling pack retention element—for example, in the form of a box, cage, slot or clip—to position the moisture controlling pack(s) at a preferred location for optimal effect and easy container content access.

The cover of a device assembly for perishables preservation, in accordance with some embodiments, may include a charger/communication socket. The socket may for example take the form of a USB-C adapter and may include either a regular plug-receiving, or a magnetic, connection type for charging the device's battery and providing direct cable communication with it.

The socket/port (e.g. USB-C) may be built into an indentation on the top or side of the device's cover, to secure an adapter/plug into the socket/port and to facilitate magnetic port-adapter connection for charging/communication. When connected to the device's cover, the adapter/plug may be flush (i.e. contiguous to, having same height as, not protruding over), or close to flush, with the outer surface of the cover.

According to some embodiments, the adapter/plug, when connected to the socket/port, may magnetically connect to a magnetic adapter of a charging cable. Removal of the adapter/plug from the device cover socket/port may expose the socket/port and thus facilitate a standard connection (i.e. non-magnetic, e.g. USB-C) of a cable directly into the socket/port for charging the device and/or for data transfer purposes.

According to some embodiments, a device cover socket/port such as a USB-C port may facilitate a Direct Connect Override, enabling mobile device application control over the container device (e.g. open/unlock the cover, reset the password via the application, add labels, etc.). A mobile device application, in accordance with embodiments, may initially attempt to connect to the device over Bluetooth, if the connection is not successful, a direct wired connection of the mobile device into the USB-C port on the device's cover may be made to facilitate communication therebetween and override Bluetooth/other connection functionality.

Reference is now made to FIG. 1A, where there is shown a diagram of an exemplary device for perishables preservation (10), in accordance with some embodiments. The shown device (10) includes a cover (100) and a container (200) having a protective non-slip base (210). The cover (100), on its outside housing, includes: a vacuum release button (110) for releasing vacuum within the container; a power button (120) to turn the device (10) on and initiate vacuum generation and maintenance within the container (200), and off, to halt the cycle; a cover air release opening (130) for releasing the air pumped from within the container (200); and a charger socket opening (135) for charging a battery (not shown) located within the cover (100). The cover (100) is shown to further include, along its bottom edges, a silicon/other seal (140) to prevent air from traveling into, and out of, the container (200) when closed with the cover (100), facilitating vacuum generation.

Figure 1B:
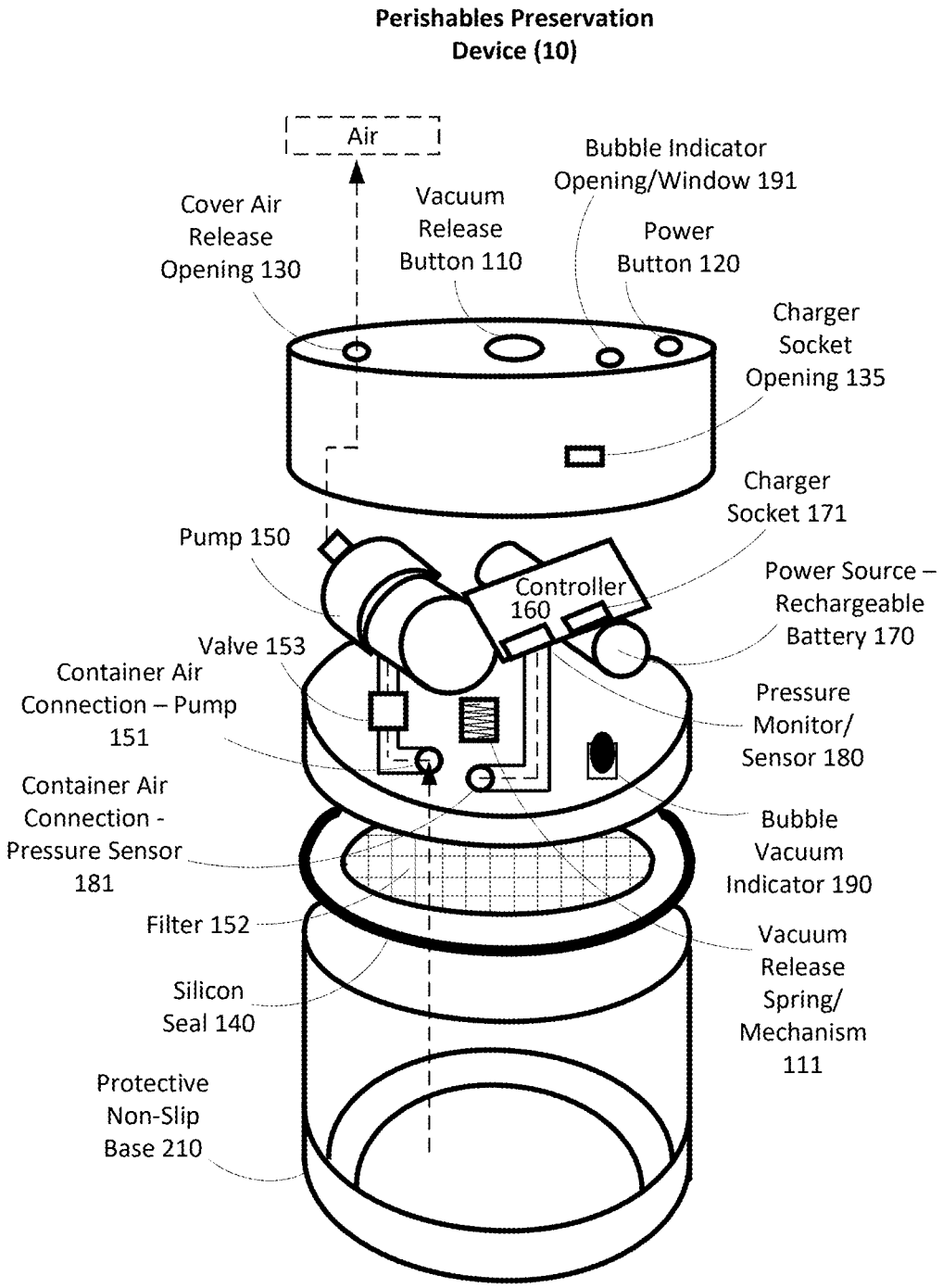
FIG. 1B is an exploded view diagram of an exemplary device for perishables preservation, in accordance with some embodiments.

Reference is now made to FIG. 1B, where there is shown an exploded view diagram of an exemplary device for perishables preservation (10), in accordance with some embodiments. In the figure, the internal components of the cover (100) are shown. The shown pump (150), pumps air from within the container (200) through the cover's filter (152), the container air connection/pass of the pump (151), and the filtering valve (153); and then out to the surroundings through the cover air release opening (130).

The cover (100) is shown to further include: a controller (160) for managing the operation of the pump, and any other electric component of the cover (100) described herein. The controller (160) is shown to be functionally connected to a charger socket/circuitry (171) for charging the shown rechargeable battery (170) and/or for wired connection communication between the cover (100) and the mobile device container application (420); and, connected to a pressure monitor/sensor (180) for measuring the pressure within the container (200)—through the container air connection/pass of the pressure sensor (181)—and relaying indicative signals to the controller (160) for it to accordingly initiate, and halt, the operation of the pump (150).

Further shown is a vacuum release spring/mechanism (111) for setting an open air pass between the outside surroundings of the device (10) and the interior space of the container (200)—when the vacuum release button (110) is pushed—thereby allowing air in and releasing the vacuum within the container (200), and also facilitating/enabling the opening of the cover (100), previously fastened to the container (200) and 'locked' by the vacuum.

A bubble vacuum indicator (190)—in the form of a flexible balloon—is shown connected to the container through an air connection/pass, such that when vacuum is generated within the container (200) it shrinks from its neutral/default position—'inflated' and popping/showing out of a respective opening/window (191) on the top of the cover (100)—disappearing from its opening/window (191) view, and indicating the 'currently vacuumed' status of the container (200).

Figure 1C:
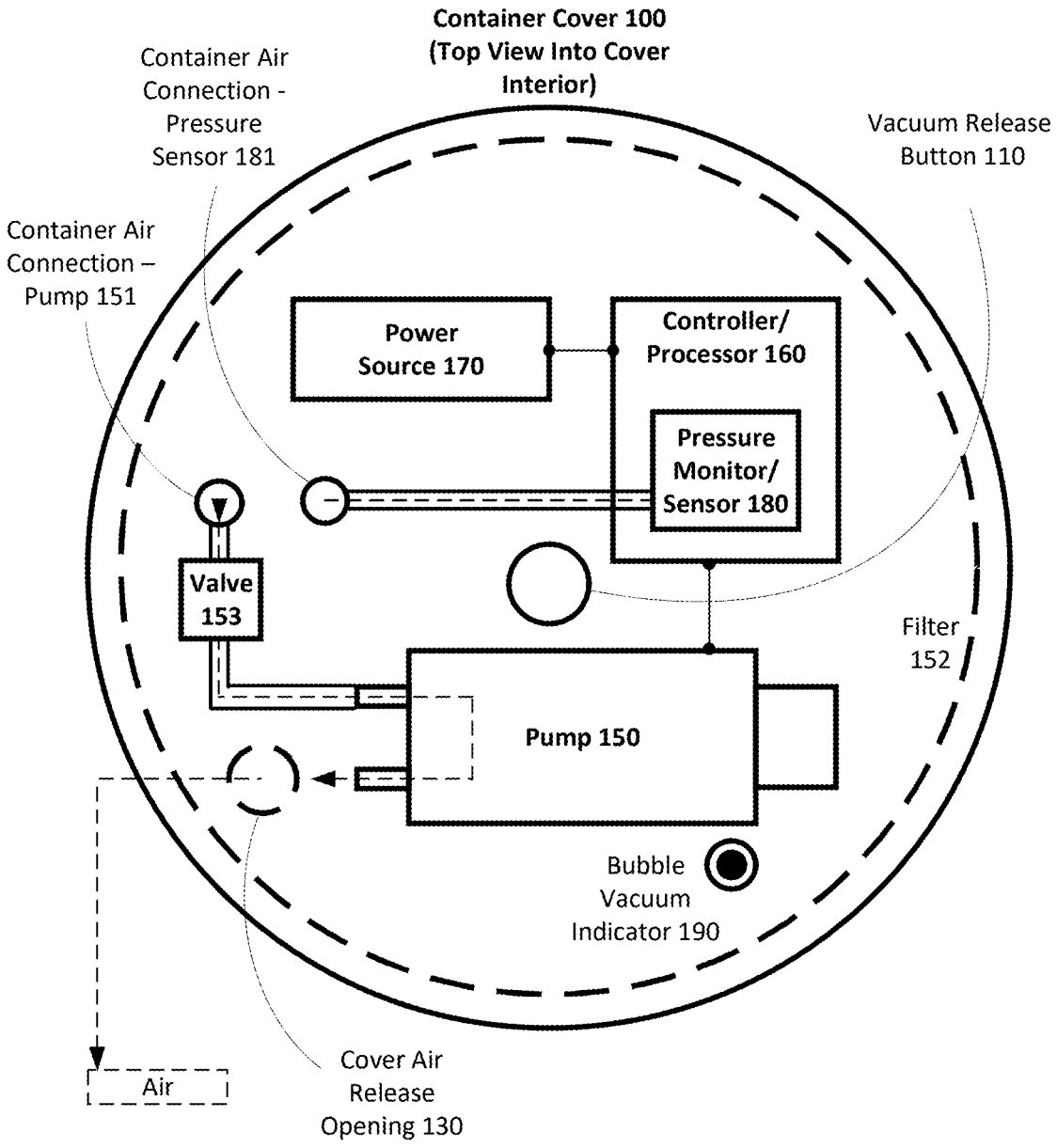
FIG. 1C is a top view diagram into a cover of an exemplary device for perishables preservation, in accordance with some embodiments.

Reference is now made to FIG. 1C, where there is shown a top view diagram into a cover (100) of an exemplary device for perishables preservation (10), in accordance with some embodiments. In the figure, components within the cover, and their interrelations, are shown and exemplified. The shown pump (150) pulls air from within the container (200) to generate vacuum within it. The air is pumped from within the container through a 'container air connection/pass—pump' (151) connected by a tube to the pump (150). The pumped air, when leaving the container (150), is passed through the shown filter (152) positioned at the bottom of the cover and covering at least the 'container air connection/pass—pump' (151). The pumped air is further filtered by the shown valve (153), prior to being released to the outside/surroundings of the device (10) through a cover air release opening (130) at the top of the cover (100).

The shown pressure monitor/sensor (180), functionally connected to the controller/processor (160) measures the air pressure level within the container through the shown 'container air connection/pass—pressure sensor' (181). The shown power source or battery (170) provides electric power to operate the controller/processor (160), the pump (150) and the pressure monitor/sensor (180).

The shown bubble vacuum indicator (190) is balloon/bubble shaped and made of a flexible material. Once air pressure is lowered within the container (200), the bubble vacuum indicator (190), through a container air connection/pass, is shrunk by the low pressure under it, disappearing from a complementary pop-out window on the top of the cover (100), thereby indicating a 'vacuumed' state. As vacuum levels drop and pressure inside the container starts rising, the bubble fills up with air, swells/stretches-upward, and shows through the pop-out window to indicate loss of vacuum. Substantially at the middle of the cover (100) a vacuum release button (110), for opening an air channel between the container (100) and the outside/surroundings of the device (10) is shown. The formed air channel releases the vacuum, thereby also facilitating the opening of the cover (100)—previously pulled down and retained over the container's (100) opening by the vacuum's power.

Figure 1D:
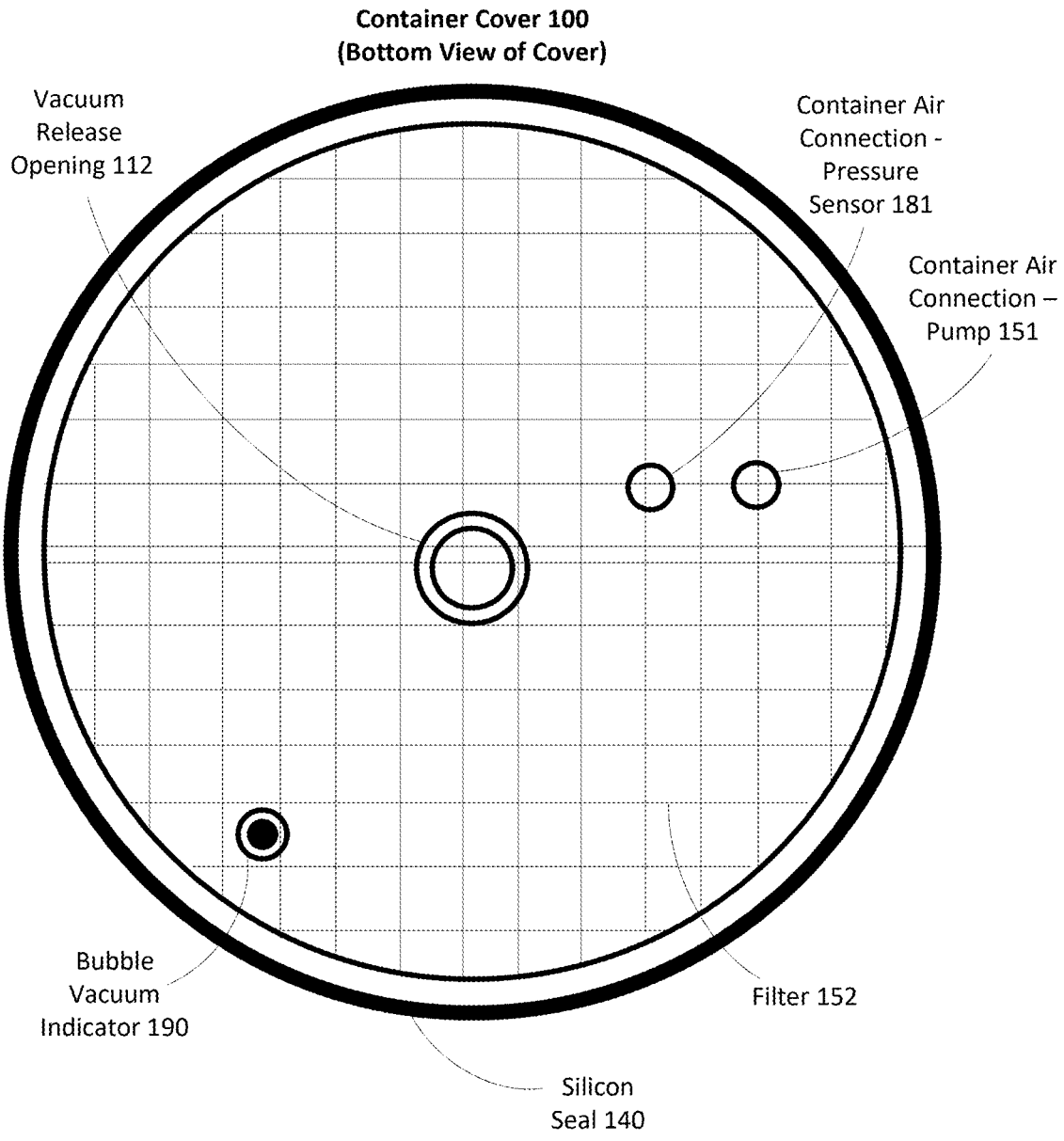
FIG. 1D is a bottom view diagram of a cover of an exemplary device for perishables preservation, in accordance with some embodiments.

Reference is now made to FIG. 1D, where there is shown a bottom view diagram of a cover (100) of an exemplary device for perishables preservation (10), in accordance with some embodiments. In the figure, the bottom, container (200) facing side, of the 'container air connection/pass—pump' (151), the 'container air connection/pass—pressure sensor' (181), the vacuum release opening (112), and the bubble vacuum indicator (190), are shown. Further shown are the filter (152), covering the different air connections, passes, and openings, and the Silicon seal (140) for air sealing between the cover (100) and the container (200).

Figure 1E:
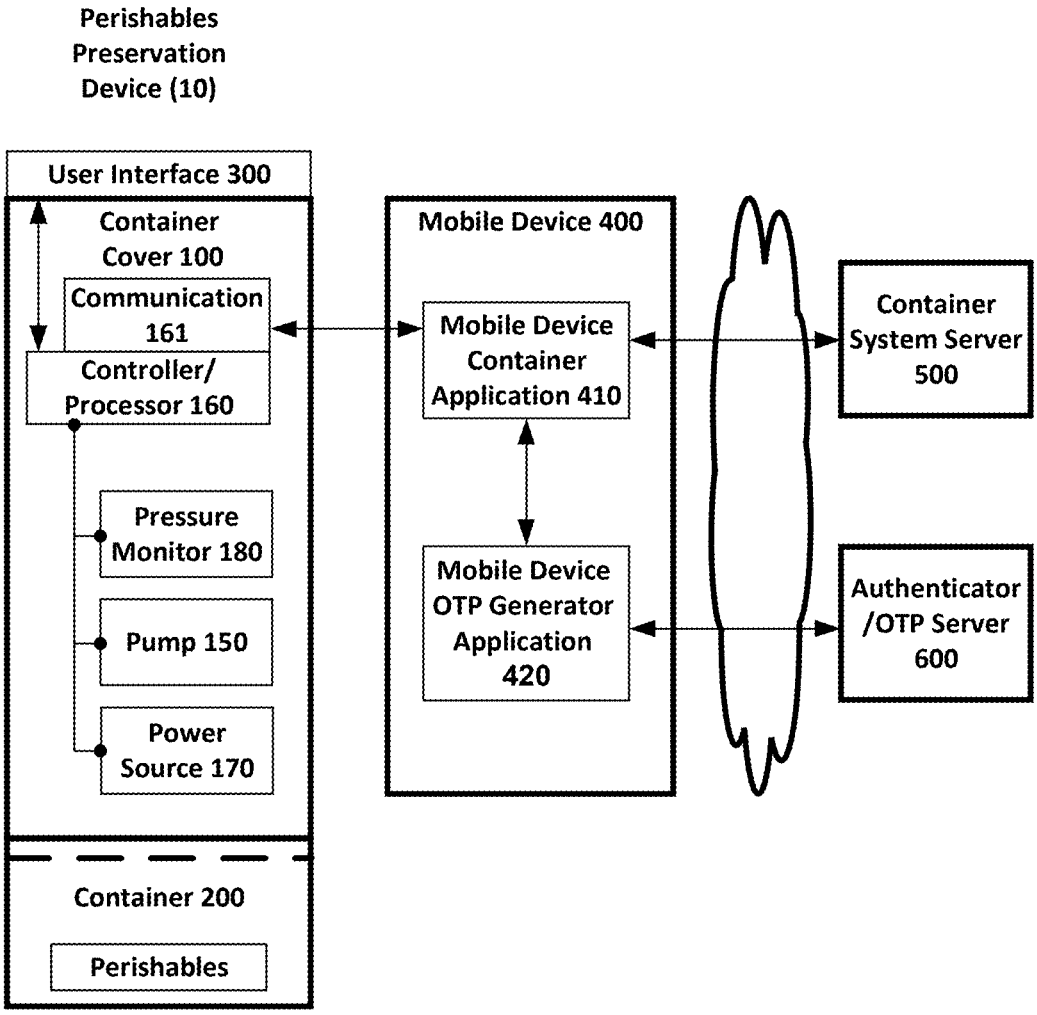
FIG. 1E is a block diagram of an exemplary system for perishables preservation, in accordance with some embodiments.

Reference is now made to FIG. 1E, where there is shown a block diagram of an exemplary system for perishables preservation, in accordance with some embodiments. In the figure, the perishables preservation device (10) is shown to include a container (200) housing perishables, a container cover (100) and a user interface (300). The cover (100) includes a pump (150) for generating vacuum in the container (200), an electric power source (170) and a pressure monitor (180). The shown controller/processor (160) is functionally associated with a communication circuitry/module (161) for communicating with a mobile device application (410) installed on a user mobile device (400). The mobile device container application (410) can be used to remotely control the container device's (10) operation, such as turning it on and off, turning on and off an interior container light (240) and triggering vacuum generation or vacuum release.

A code or password, generated, received by, and/or entered into the application (410) may be communicated to the container device, and verified by the controller/processor (160), prior to executing received commands, such as vacuum release. In the figure, a one time password (OTP) generator application (420) is triggered by the mobile device container application (410) to request and receive an OTP from an authentication/OTP server (600). The OTP is then used by the container application (410) to authenticate itself with the device (10), such that communicated commands are processed and executed by the device. The mobile device container application (410) may store/receive a unique code, associating it with one or more specific devices (10). Received commands may be inspected for the unique code—to verify that the sender of the command is indeed a mobile device container application (410) associated with that specific device—prior to device (10) command execution.

Figure 2A:
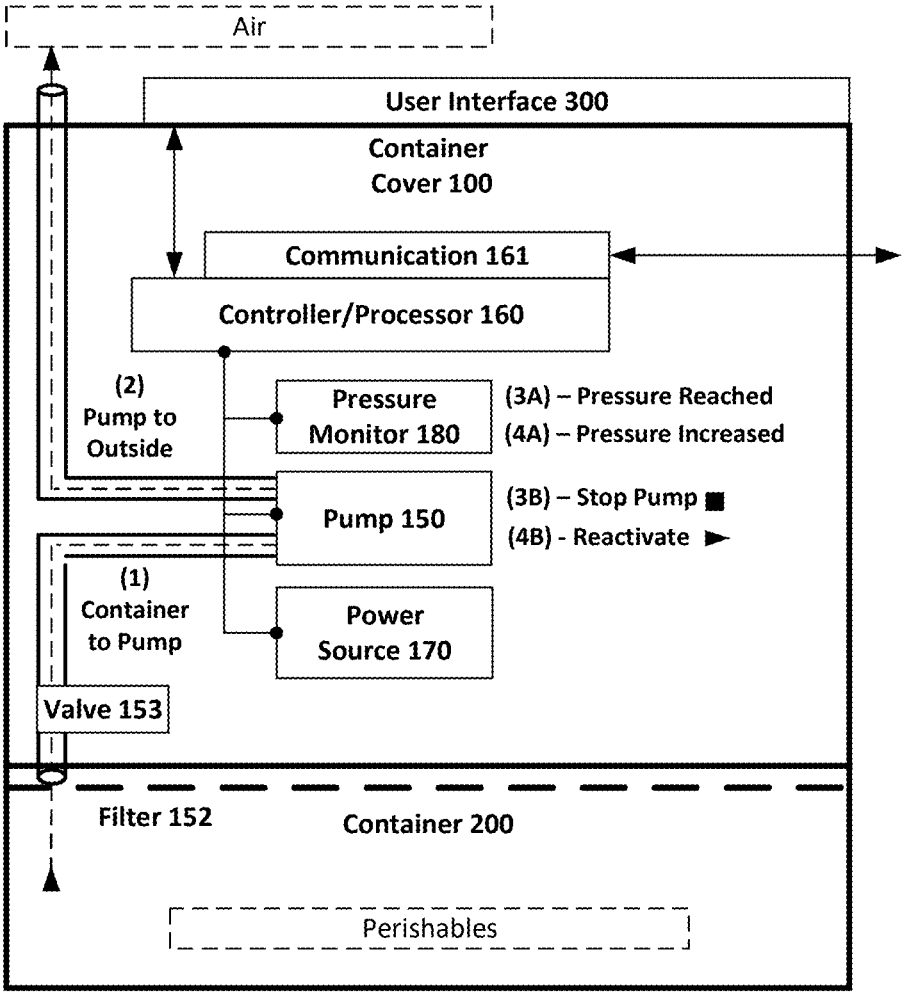
FIG. 2A is a diagram of an exemplary device for perishables preservation, illustrating a device vacuum generation and maintenance cycle, in accordance with some embodiments.

Reference is now made to FIG. 2A, where there is shown a diagram of an exemplary device for perishables preservation (10), illustrating a device vacuum generation and maintenance cycle, in accordance with some embodiments. Shown steps include: (1) Pump (150) pulls air from the container (200) to generate vacuum. The removed air is passed through the shown filter (152) and filtering valve (153) to, at least partially, remove smells/odors originating from the container (200) stored perishables. (2) The pumped air is then pushed out of the cover (100) to the outside of the container. (3A) Upon indication by the pressure monitor (180) that the aspired vacuum-level/low-pressure has been reached, (3B) the controller/processor (160) halts the operation of the pump (150). (4A) Upon indication by the pressure monitor (180) that pressure in the container has increased (i.e. vacuum lost) over a threshold level, (4B) the controller/processor (160) reactivates the pump (150) to regenerate the aspired vacuum level.

Figure 2B:
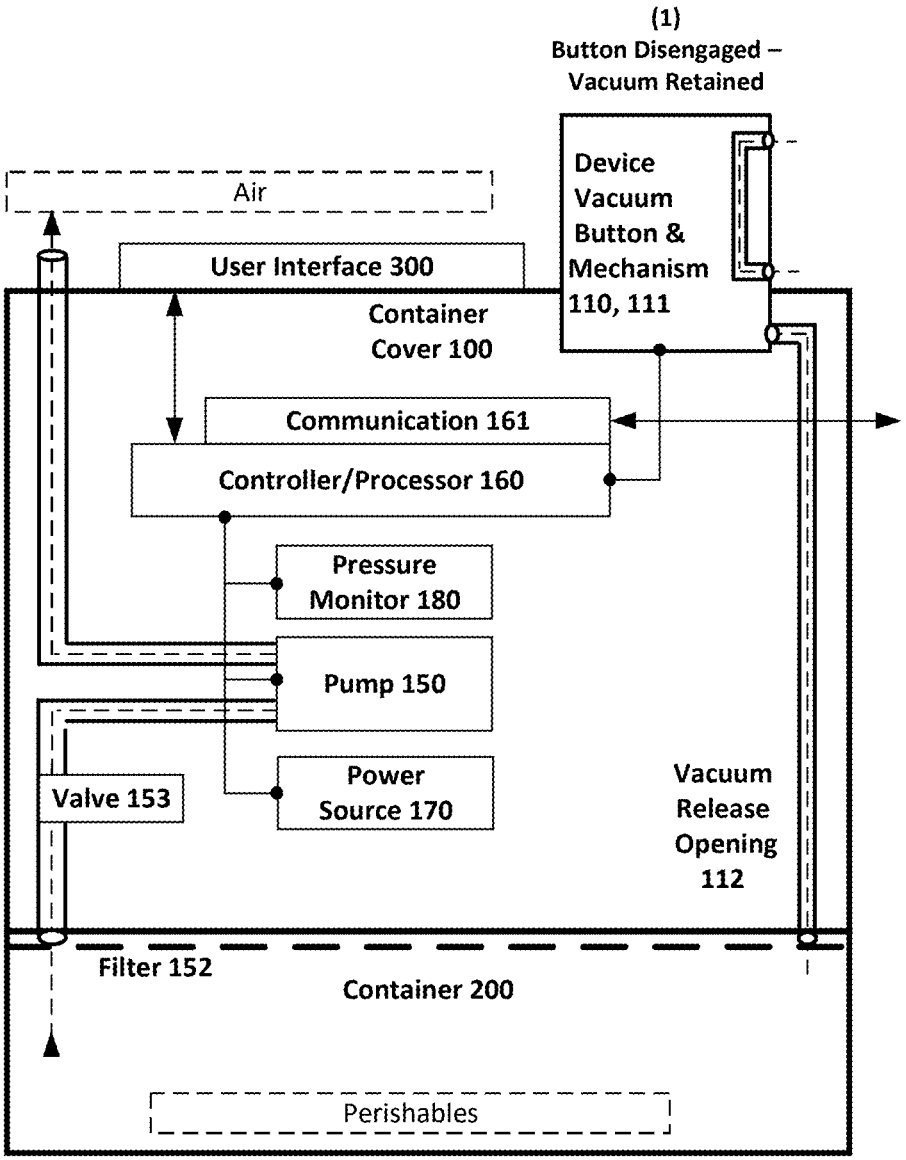
FIG. 2B is a diagram of an exemplary device for perishables preservation, illustrating a first stage vacuum release cycle, triggered by a device vacuum button and mechanism, in accordance with some embodiments.

Reference is now made to FIG. 2B, where there is shown a diagram of an exemplary device for perishables preservation (10), illustrating a first stage vacuum release cycle, triggered by a device vacuum button and mechanism (110, 111), in accordance with some embodiments. Shown step includes: (1) The device vacuum button and mechanism (110, 111) are shown to be in a first, disengaged, position, wherein the pass of air coming through the vacuum release opening (112) is blocked by the disengaged device vacuum button and mechanism (110, 111).

Figure 2C:
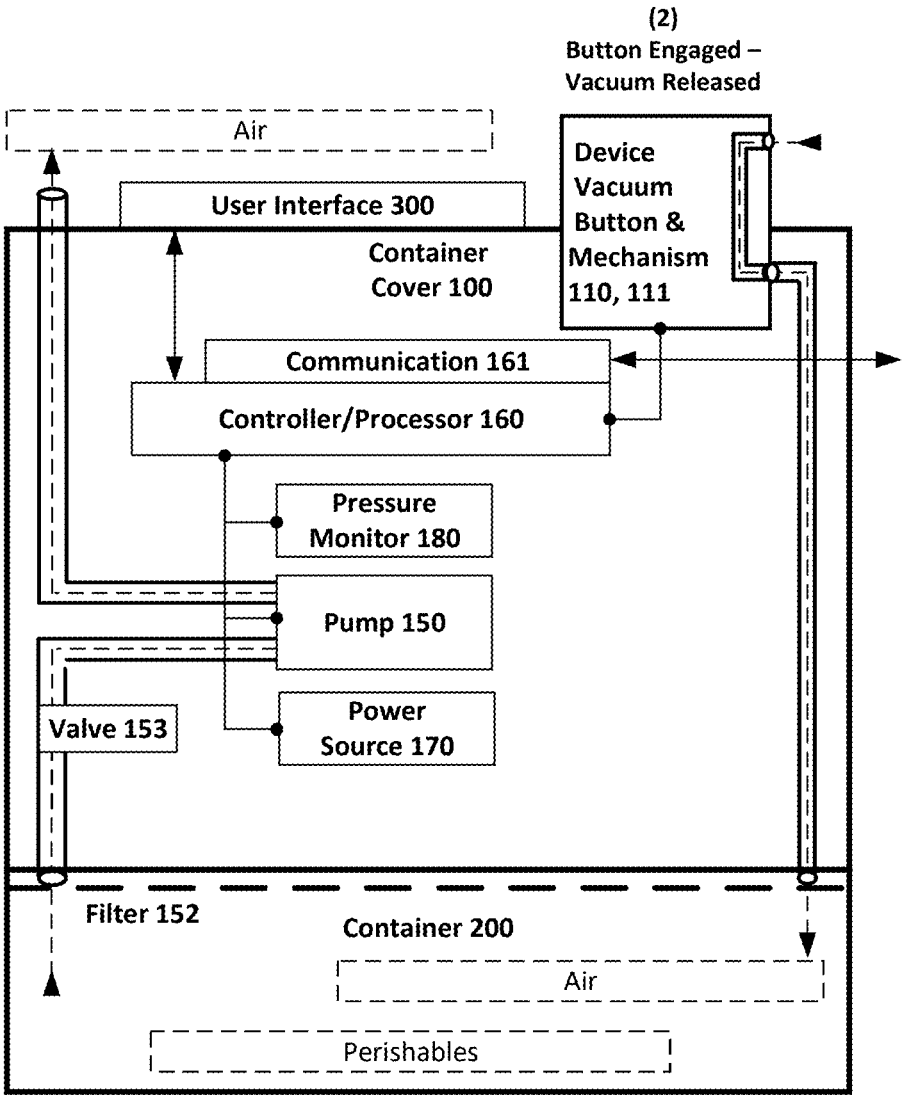
FIG. 2C is a diagram of an exemplary device for perishables preservation, illustrating a second stage vacuum release cycle, triggered by a device vacuum button and mechanism, in accordance with some embodiments.

Reference is now made to FIG. 2C, where there is shown a diagram of an exemplary device for perishables preservation (10), illustrating a second stage vacuum release cycle, triggered by a device vacuum button and mechanism (110, 111), in accordance with some embodiments. Shown step includes: (2) The device vacuum button and mechanism (110, 111) are shown to be in a second, engaged, position, wherein the pass of air coming through the vacuum release opening (112) is open by the engaged device vacuum button and mechanism (110, 111), enabling air from the outside surrounding to flow into the container (200) through the shown pass, thereby at least partially equalizing the inside and outside pressures, releasing the vacuum, and facilitating the opening of the no longer vacuumed container (200). The device vacuum button and mechanism (110, 111) may further, upon its engagement, signal to the controller/processor (160) to halt the operation of the vacuum generating pump (150).

Figure 3A:
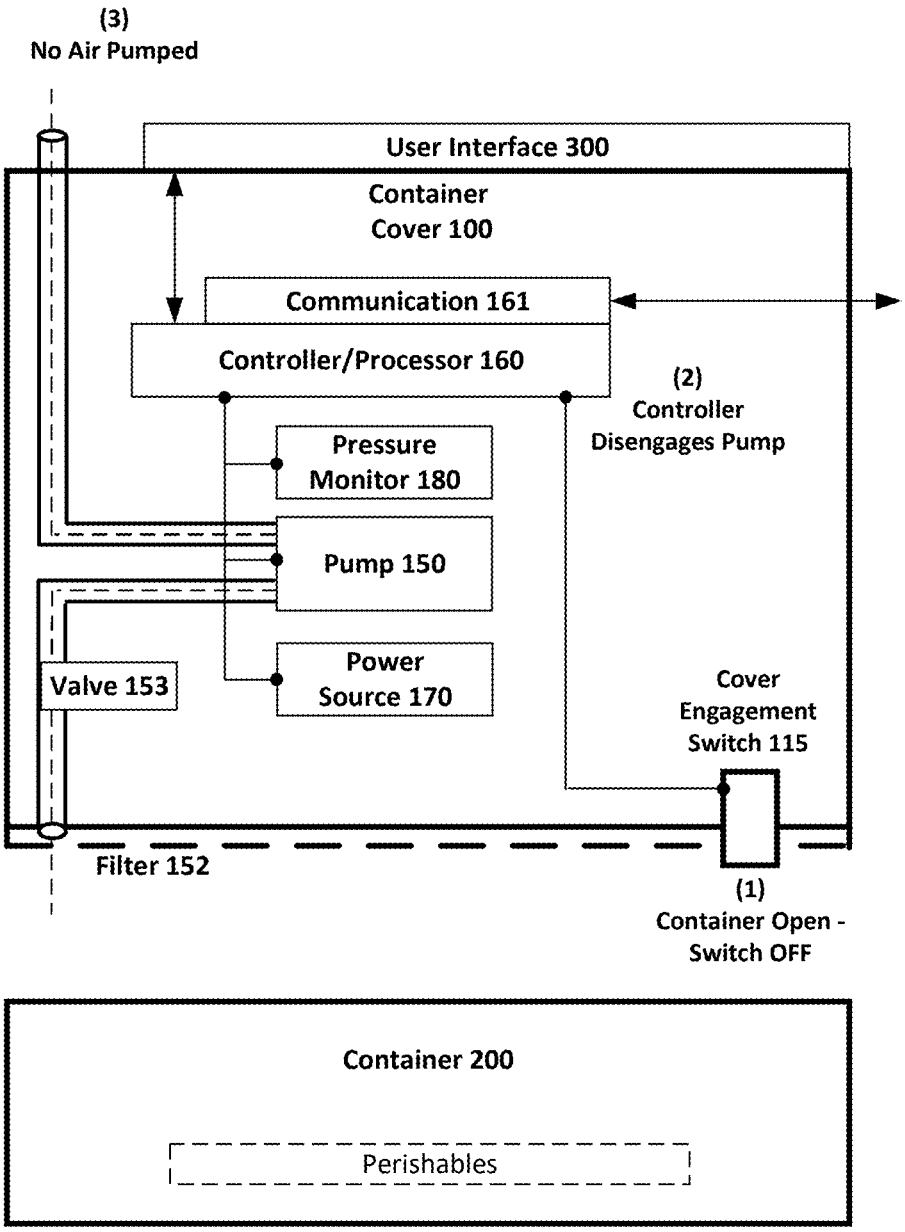
FIG. 3A is a diagram of an exemplary device for perishables preservation, illustrating a first stage of a device cover engagement switch triggered pump disconnect/connect cycle, in accordance with some embodiments.

Reference is now made to FIG. 3A, where there is shown a diagram of an exemplary device for perishables preservation (10), illustrating a first stage of a device cover engagement switch (115) triggered pump (150) disconnect/connect cycle, in accordance with some embodiments. Shown steps include: (1) The container (200) is open, and the cover engagement switch (115) disengaged. (2) As the switch is disengaged, the controller/processor (160) disengages the operation of the pump (150) and, (3) no air is pumped.

Figure 3B:
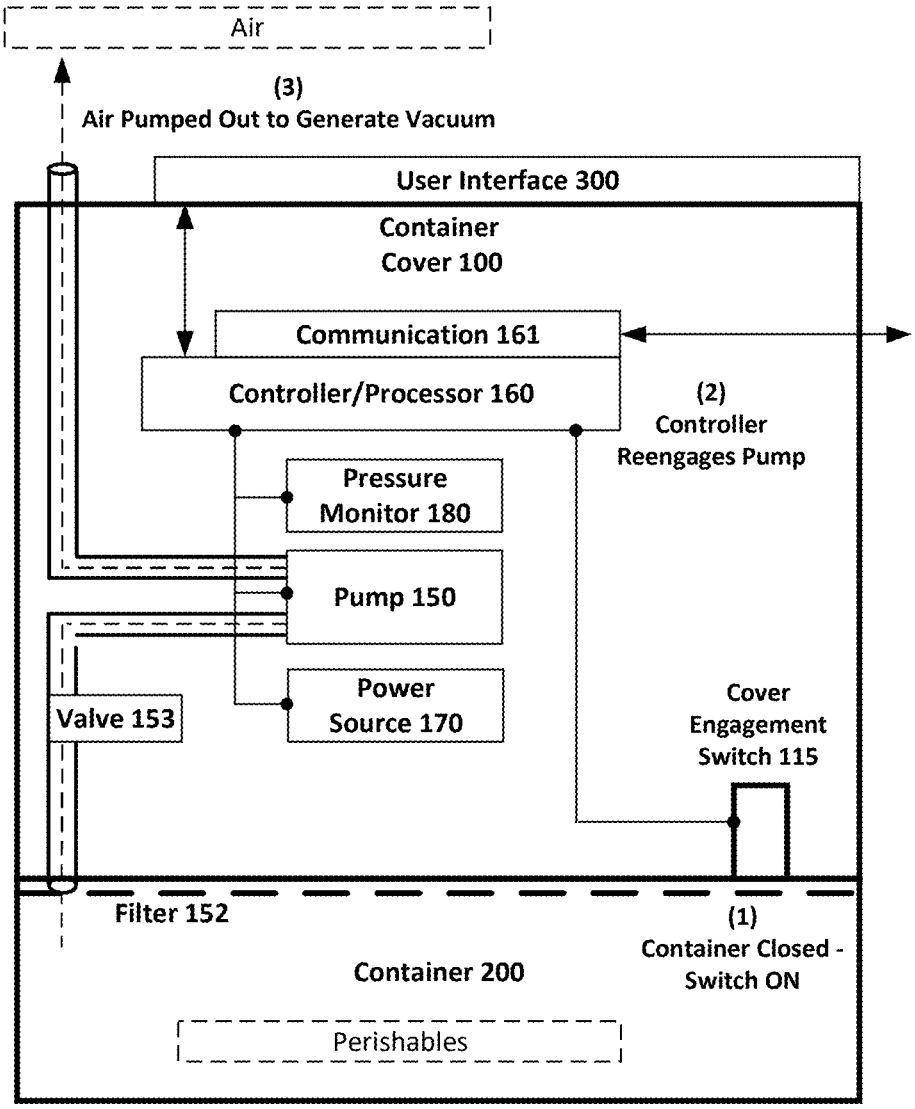
FIG. 3B is a diagram of an exemplary device for perishables preservation, illustrating a second stage of a device cover engagement switch triggered pump disconnect/connect cycle, in accordance with some embodiments.

Reference is now made to FIG. 3B, where there is shown a diagram of an exemplary device for perishables preservation (10), illustrating a second stage of a device cover engagement switch (115) triggered pump (150) disconnect/connect cycle, in accordance with some embodiments. Shown steps include: (1) The container (200) is now closed, engaging the cover engagement switch (115). (2) As the switch is engaged, the controller/processor (160) reengages the operation of the pump (150) and, (3) air is pumped to the outside, generating low-pressure/vacuum within the container (200).

Figure 4A:
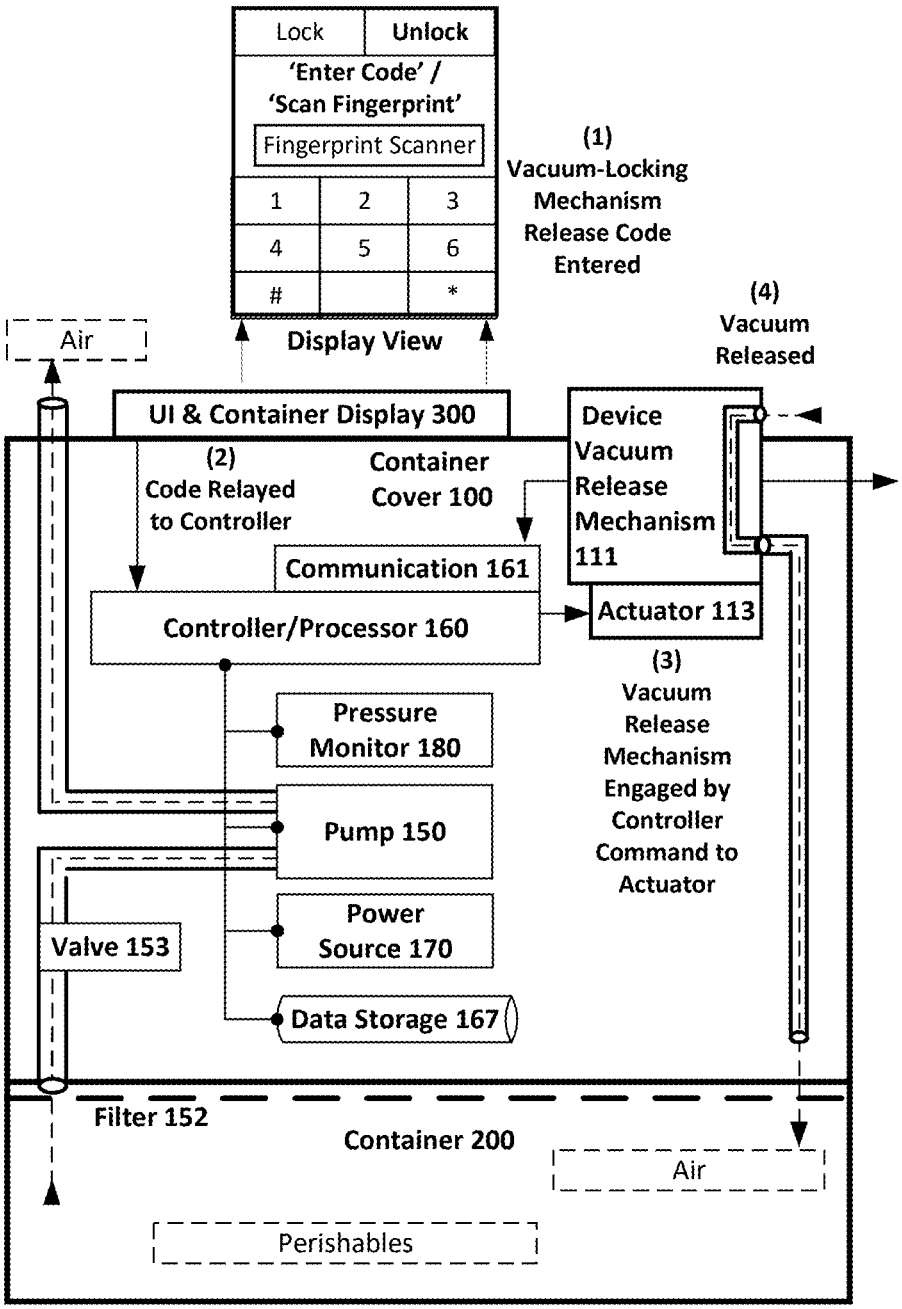
FIG. 4A is a diagram of an exemplary device for perishables preservation, illustrating a device cover vacuum-locking mechanism, wherein a PIN/code/combination/biometric entered through a device user interface triggers a vacuum release cycle, in accordance with some embodiments.

Reference is now made to FIG. 4A, where there is shown a diagram of an exemplary device for perishables preservation (10), illustrating the operation of a device cover vacuum-locking mechanism, wherein a PIN/code/password/combination/biometric entered through a device user interface (300) triggers a vacuum release cycle (mechanism release/pump disconnection), in accordance with some embodiments. Shown steps include: (1) A vacuum release code and/or biometric is input by the user through the user interface and display (300). (2) The code/biometric is relayed to the controller/processor (160), (3) once the code/biometric is verified, the controller/processor (160) commands the actuator (113) to engage the vacuum release mechanism (111), and (4) vacuum within the container (200) is released. The controller/processor (160) is shown to be functionally connected to a data storage (167) for registering/recording, storing, and referencing for verification—data such as PINs, codes, passwords, combinations, biometrics, functions, counters and/or any other information associated with the device for perishables preservation (10).

Figure 4B:
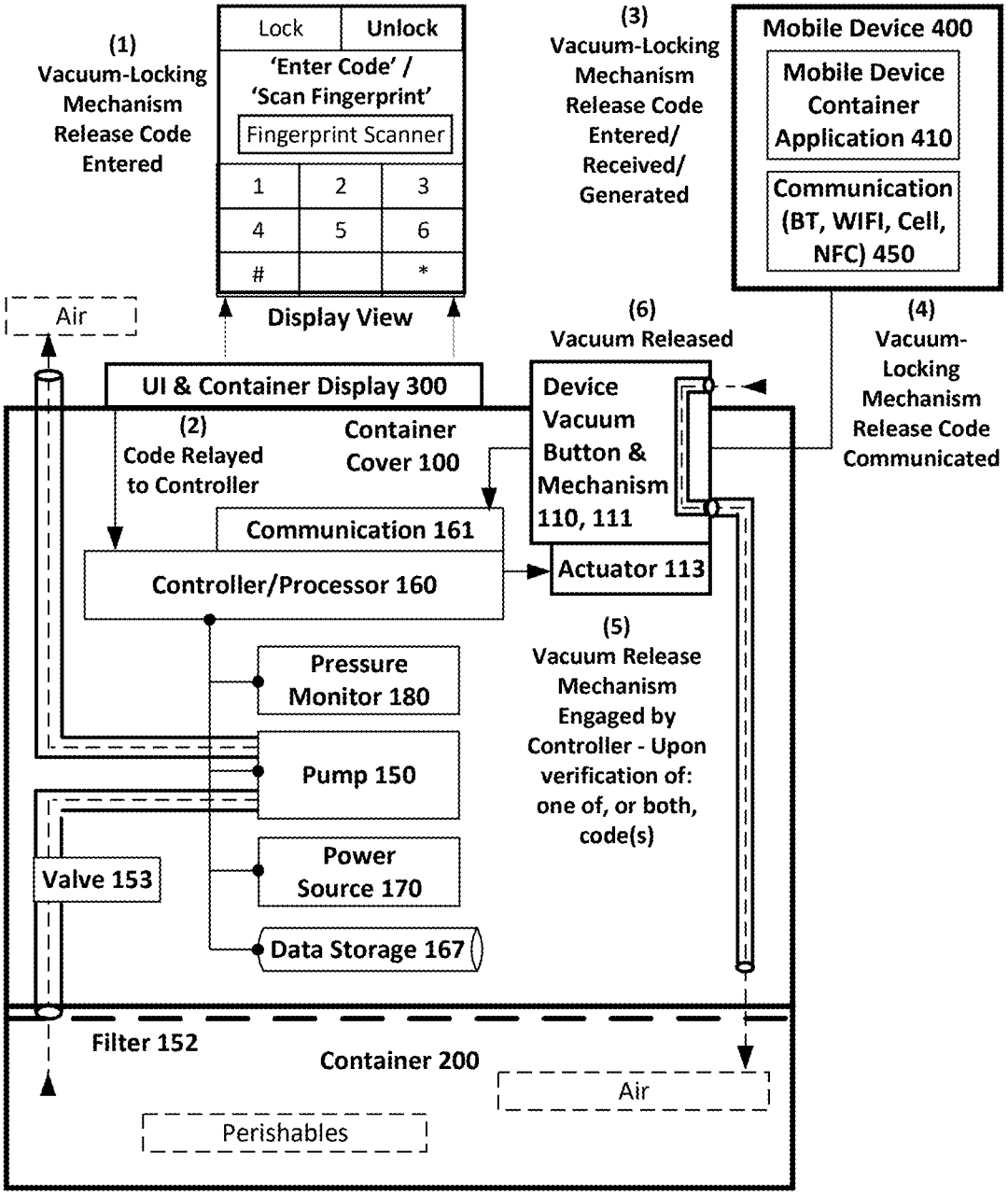
FIG. 4B is a diagram of an exemplary system for perishables preservation, illustrating a device cover vacuum-locking mechanism, wherein a two-factor authentication (2FA) scheme—a PIN/code/combination/biometric entered through a device user interface in combination with a password/code relayed from a user mobile device application—triggers a vacuum release cycle, in accordance with some embodiments.

Reference is now made to FIG. 4B, where there is shown a diagram of an exemplary system for perishables preservation, illustrating the operation of a device cover vacuum-locking mechanism, wherein a two-factor authentication (2FA) scheme—a PIN/code/password/combination/biometric entered through a device user interface (300) in combination with a password/code relayed from a user mobile device application (410)—triggers a vacuum release cycle, in accordance with some embodiments. Shown steps include: (1) A first vacuum release code and/or biometric is input by the user through the user interface and display (300). (2) The code/biometric is relayed to the controller/processor (160). (3) A second vacuum release code is entered to, received by and/or generated by the mobile device application (410), and (4) communicated to the controller (160). (5) once both codes are verified, the controller/processor (160) commands the actuator (113) to engage the vacuum release mechanism (111), and (6) vacuum within the container (200) is released. The controller/processor (160) is shown to be functionally connected to a data storage (167) for registering/recording, storing, and referencing for verification—data such as PINs, codes, passwords, combinations, biometrics, functions, counters and/or any other information associated with the device for perishables preservation (10).

Figure 4C:
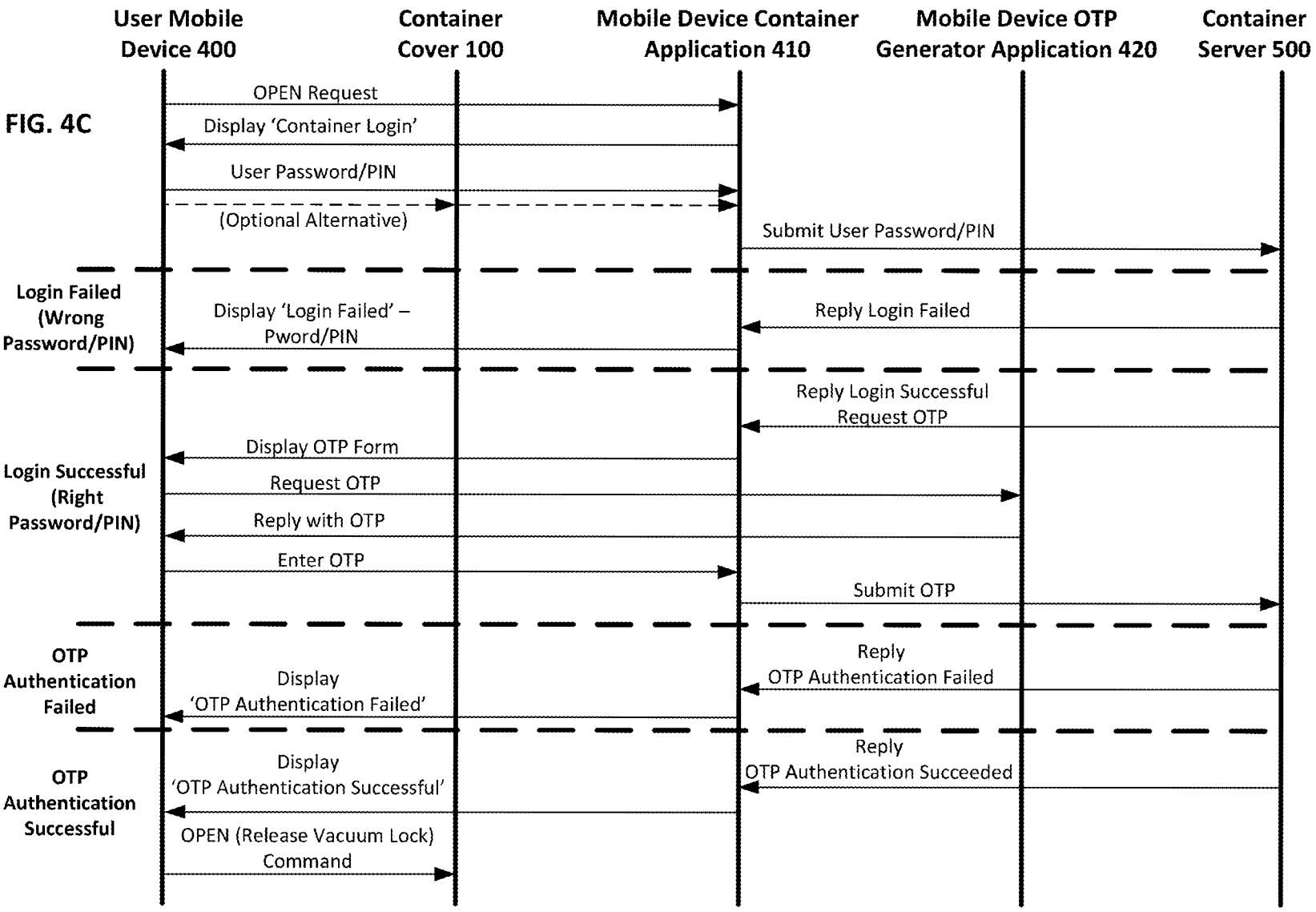
FIG. 4C is a communication diagram of an exemplary system for perishables preservation, illustrating a device cover vacuum-locking mechanism, wherein a two-factor authentication (2FA) scheme including a one-time password triggers a vacuum release cycle, in accordance with some embodiments.

Reference is now made to FIG. 4C, where there is shown a communication diagram of an exemplary system for perishables preservation, illustrating the operation of a device cover vacuum release mechanism (111) utilized for vacuum-locking of the device for perishables preservation (10), wherein a two-factor authentication (2FA) scheme including a one-time password triggers a vacuum release cycle, in accordance with some embodiments.

In the figure, a user entered mobile device (400) OPEN request is received by the mobile device container application (410). The application then displays a 'Container Login' page on the mobile device's (400) screen. The user entered password/pin/code is received by the device container application (410) and submitted to the container device server (500). Alternatively, the user entered password/pin/code may be initially sent to the device cover (100) and then communicated for verification to the container device server (500).

If login fails (e.g. wrong password/pin/code) the server (500) sends a 'login failed' reply to the mobile device container application (410) that presents/notifies it to the user over an output component of the mobile device's (400), such as the screen/display and/or speaker.

If login is unsuccessful, a 'login failed' message is sent from the container server (500) to the mobile device container application (410) that displays a 'login failed' message on the mobile device's (400) screen.

If login is successful, a 'login successful' and an 'OTP request' messages are sent from the container server (500) to the mobile device container application (410) that displays an OTP form associated with the 'OTP request'. The user filled OTP form data is then relayed to a mobile device OTP generator application (420) that issues, and replies with, the generated OTP. The received OTP is then entered into the mobile device container application (410) that submits it to the container server (500).

If the OTP authentication fails, the server (500) sends an 'OTP authentication failed' message to the mobile device container application (410) that displays an 'OTP authentication failed' message on the mobile device's (400) screen.

If the OTP authentication succeeds, the server (500) sends an 'OTP authentication succeeded' message to the mobile device container application (410) that: displays an 'OTP authentication succeeded' message on the mobile device's (400) screen; and, sends an OPEN command to the container cover (100) for the controller/processor (160) to engage the vacuum release mechanism (111) and/or disengage the pump (150), in response.

Figure 4D:
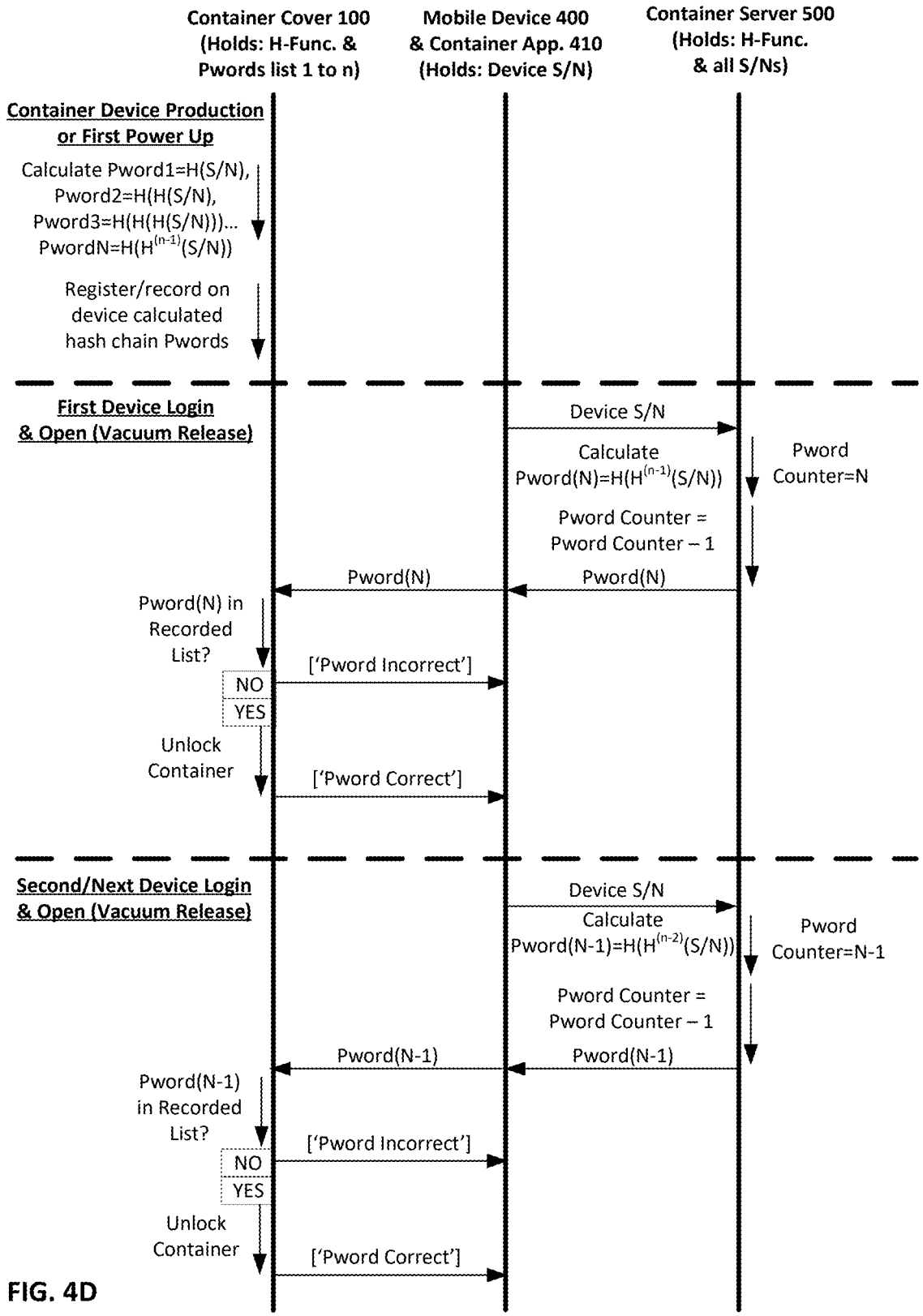
FIG. 4D is a communication diagram of an exemplary system for perishables preservation, illustrating a device cover vacuum-locking mechanism, wherein a first hash chain scheme including a one-time password triggers a vacuum release cycle, in accordance with some embodiments.

Reference is now made to FIG. 4D, where there is shown a communication diagram of an exemplary system for perishables preservation, illustrating a device cover vacuum-locking mechanism (111), utilized for vacuum-locking of the device for perishables preservation (10), wherein a first hash chain scheme including a one-time password triggers a vacuum release cycle, in accordance with some embodiments.

In the figure, values of a hash chain, based on the specific container/perishables-preservation device's (10) serial number, are shown to be calculated at the device (10) production stage or during its first power up. The hash chain may for example be calculated by the container cover (100) controller/control-circuitry/processor (160) and registered/recorded onto a data-storage/memory associated therewith.

As part of a first container device (10) login and opening, the device's serial number is communicated by the container device (10), through the mobile device (400) and container application (410), to the container/system server (500). During the first container device (10) login and opening, a password counter is set to the value N, and password (N) is calculated by applying the hash function used N times, initially to the serial number itself, and then to the result of each prior hash function calculation, such that password (N) equals to H ($H^{(n-1)}$(S/N)). The password counter is then decreased by 1 and calculated password (N) is communicated back to the mobile device (400) and container application (410) and on to the container cover (100).

The container cover controller/control-circuitry (160) then compares the received password (N) to the values stored in its list of passwords. If password (N) is not found in the list, a 'password incorrect' message is relayed back to the mobile device (400) and presented to the user through the container application (410); and, the container device (10) remains locked and vacuumed. If password (N) is found in the list, a 'password correct' message is relayed back to the mobile device (400) and presented to the user through the container application (410); and, the container device (10) vacuum is released by the vacuum-locking mechanism (111), thereby unlocking it, and enabling its opening.

A successful, hash-chain password based, opening of the container device (10) may trigger/prompt-for a user password reset, enabling the user to substitute the issued hash chain password with his own password, entered through the container application (410) and/or the user interface (300) of the container device cover (100).

As part of a second/next container device (10) login and opening, the device's serial number is communicated by the container device (10), through the mobile device (400) and container application (410), to the container/system server (500). During the second/next container device (10) login and opening, the password counter is set (from the previous login) to the value N−1, and password (N−1) is calculated by applying the hash function used N−1 times, initially to the serial number itself, and then to the result of each prior hash function calculation, such that password (N−1) equals to H ($H^{(n-2)}$(S/N)). The password counter is then decreased by 1 and calculated password (N−1) is communicated back to the mobile device (400) and container application (410) and on to the container cover (100).

Figure 4E:
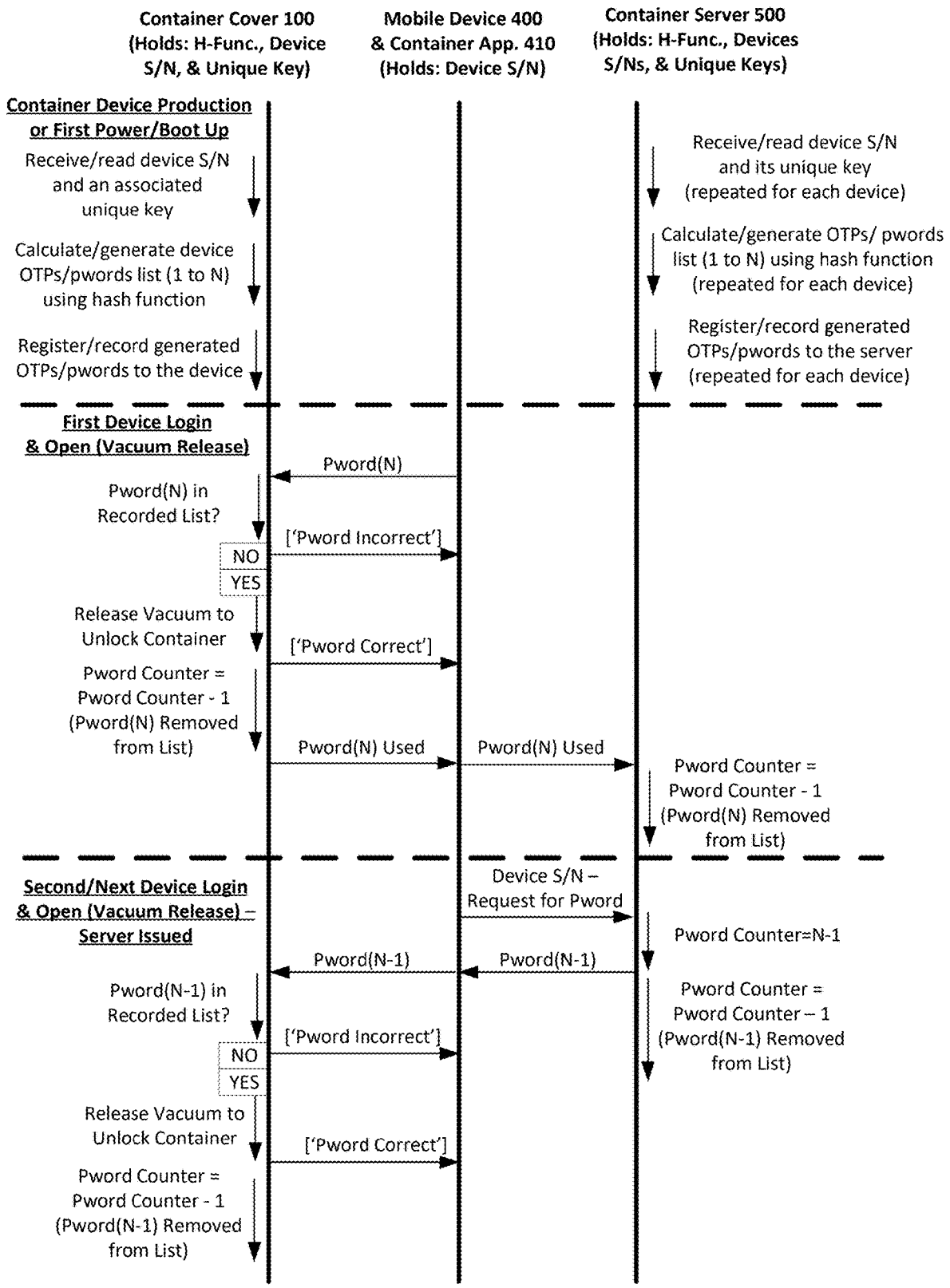
FIG. 4E is a communication diagram of an exemplary system for perishables preservation, illustrating a device cover vacuum-locking mechanism, utilized for vacuum-locking of the device for perishables preservation, wherein a second hash chain scheme including a one-time password triggers a vacuum release cycle, in accordance with some embodiments.

Reference is now made to FIG. 4E, where there is shown a communication diagram of an exemplary system for perishables preservation, illustrating a device cover vacuum-locking mechanism (111), utilized for vacuum-locking of the device for perishables preservation (10), wherein a second hash chain scheme including a one-time password triggers a vacuum release cycle, in accordance with some embodiments.

In the figure, values of a hash chain, based on the specific container/perishables-preservation device's (10) serial number and a unique key associated with it, are shown to be calculated at the device (10) production stage or during its first power up. The hash chain may for example be calculated by the container cover (100) controller/control-circuitry/processor (160) and registered/recorded onto a data-storage/memory associated therewith. Similarly, the shown container server (500) receives each container/perishables-preservation device's (10) serial number, and the unique key associated with it, and calculates the hash chain.

As part of a first container device (10) login and opening, the device's serial number and the unique key are collectively used to generate an OTP code/password that is stored on the device. Once the code has been used, it is sent by the container device (10), through the mobile device (400) and container application (410), to the container/system server (500) to keep track of which OTP's have been used. During the first container device (10) login and opening, user password (N) is entered to and communicated by the mobile device (400) and container application (410) to the device container cover (100).

The container cover controller/control-circuitry (160) then compares the received password (N) to the values stored in its list of passwords. If password (N) is not found in the list, a 'password incorrect' message is relayed back to the mobile device (400) and presented to the user through the container application (410); and, the container device (10) remains locked and vacuumed. If password (N) is found in the list, a 'password correct' message is relayed back to the mobile device (400) and presented to the user through the container application (410); and, the container device (10) vacuum is released by the vacuum-locking mechanism (111), thereby unlocking it, and enabling its opening. A successful, hash-chain OTP password based, opening of the container device (10) is shown to trigger the decrease of a container device (10) password counter and/or the removal of the already used password (N) from its passwords list; and the sending of the password used—password (N)—to the mobile device (400) and container application (410) (e.g. over a Bluetooth connection), and on, from the mobile device (400) to the container/system server (500) (e.g. through a Wi-Fi/Cellular connection). The container/system server (500), in response, decreases its own password counter and/or otherwise removes the already used password (N) from its passwords list.

As part of a second/next container device (10) login and opening, wherein the user contacts the system server (500) to retrieve a new password (e.g. forgot password), the container device (10) serial number is communicated by the mobile device (400) and container application (410), to the container/system server (500). As the password counter is now equal to (N−1), since password (N) has already been used, password (N−1) is selected and sent by the server (500) back to the mobile device (400) and container application (410) that utilizes it to try logging into and opening the container device (10). If password (N−1) is not found in the list, a 'password incorrect' message is relayed back to the mobile device (400) and presented to the user through the container application (410); and, the container device (10) remains locked and vacuumed. If password (N−1) is found in the list, a 'password correct' message is relayed back to the mobile device (400) and presented to the user through the container application (410); and, the container device (10) vacuum is released by the vacuum-locking mechanism (111), thereby unlocking it, and enabling its opening. A successful, hash-chain OTP password based, opening of the container device (10) is shown to trigger the decrease of a container device (10) password counter and/or the removal of the already used password (N−1) from its passwords list.

Figure 5A:
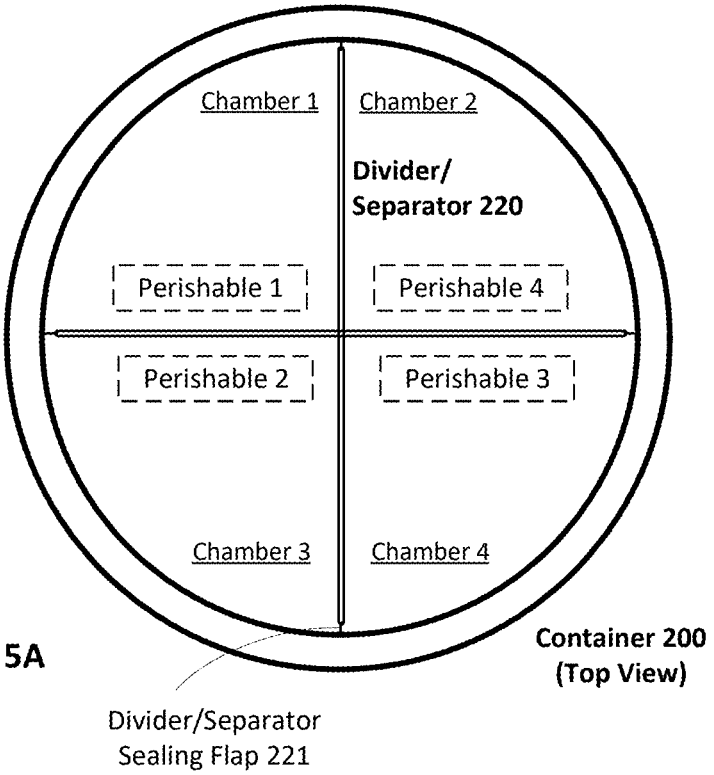
FIG. 5A is a diagram of an exemplary device for perishables preservation, wherein the device is shown open and the device container including a separator/divider component partitioning its internal space, in accordance with some embodiments.

Reference is now made to FIG. 5A, where there is shown a diagram of an exemplary device for perishables preservation (10), wherein the device is shown open and the device container (200) including a separator/divider component (220) partitioning its internal space into separate chambers, in accordance with some embodiments. Different perishable types—perishable 1, perishable 2, perishable 3, and perishable 4—are shown to be stored in each of the formed chambers. The separator/divider component (220) is shown to include a divider/separator sealing flap/tip (221) on the edge of each partition, to keep perishables' chambers sealed and separated.

Figure 5B:
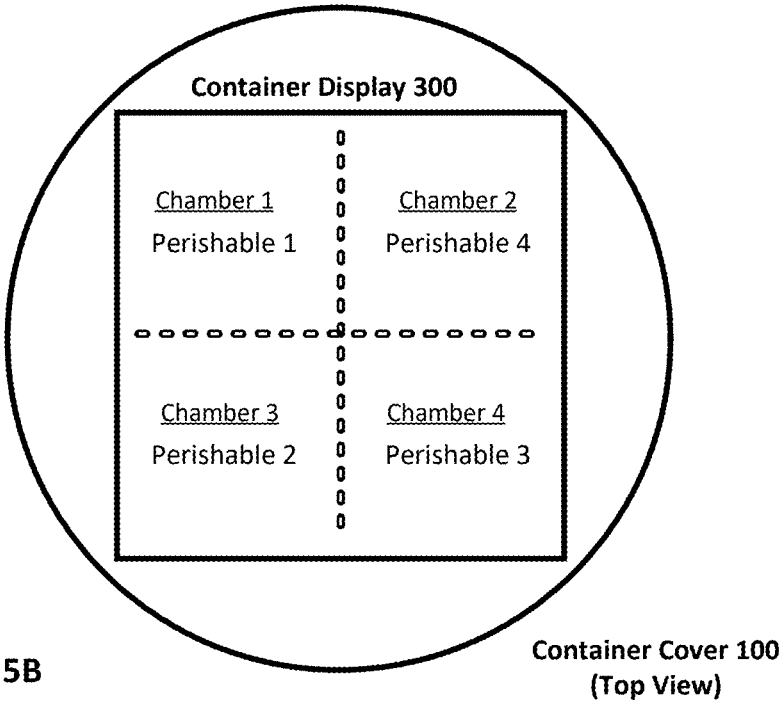
FIG. 5B is a diagram of an exemplary device for perishables preservation, wherein the device is shown closed and the device cover including a digital display presenting content labels, at positions corresponding to internal space sectors of a device container partitioned by a separator/divider component, in accordance with some embodiments.

Reference is now made to FIG. 5B, where there is shown a top view diagram of an exemplary device for perishables preservation (10), wherein the device (10) is shown closed and the device cover (100) including a user interface and digital display (300) presenting content labels for each of the chambers formed by the separator/divider component (220). The labels may be presented at positions corresponding-to/above/over their respective internal chambers/sectors of a device container (200) partitioned by a separator/divider component (220). The presented labels may include the presentations of label names corresponding to drawn/printed/marked label names within the container (200) and/or on the container divider/separator (220) partitions. For example, in the figure, the labels—Chamber 1, Chamber 2, Chamber 3, and Chamber 4—are presented in each quadrant next to the type of perishable stored in the container (200) (as shown in FIG. 5A) within the similarly labelled container chamber—perishable 1, in Chamber 1; perishable 4, in Chamber 2; perishable 2, in Chamber 3, and perishable 3, in Chamber 4.

According to some embodiments, the digital display (300) may present content labels for a subset of one or more of the chambers formed by the separator/divider component (220) and include, as part of its user interface (300), interface elements such as a touch screen or physical buttons to scroll between the presented subsets of content labels. According to further embodiments, the user interface and digital display (300) may present a label or name of the specific container device, entered by the user through the user interface (300) or the mobile device container application (410).

Figure 6A:
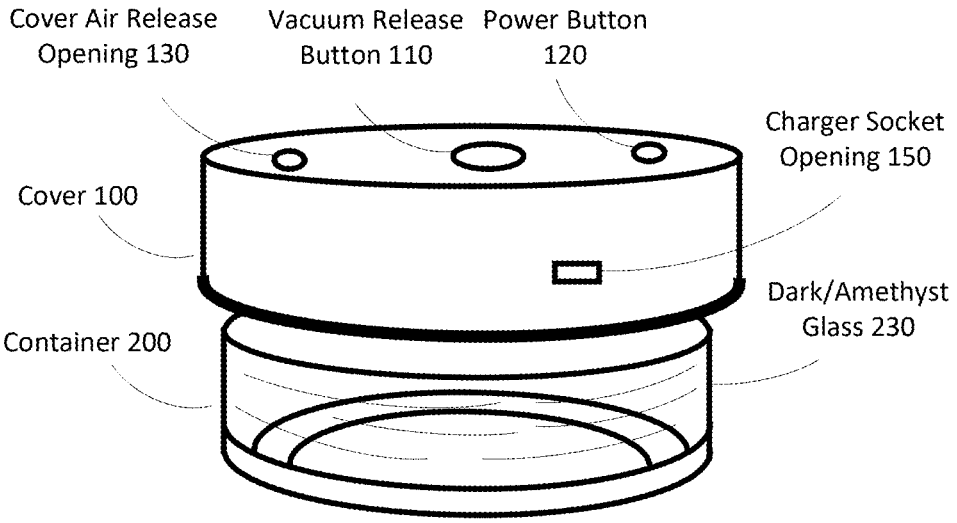
FIG. 6A is a diagram of an exemplary device for perishables preservation, wherein the shown device includes a dark glass container and has low height-to-width proportion, in accordance with some embodiments.

Reference is now made to FIG. 6A, where there is shown a diagram of an exemplary device for perishables preservation (10), wherein the shown device includes a dark glass, or amethyst glass (230), container (200), and has low height-to-width proportion, in accordance with some embodiments. The height-to-width proportion, shown in the exemplary figure, is smaller than 1-to-2.

Figure 6B:
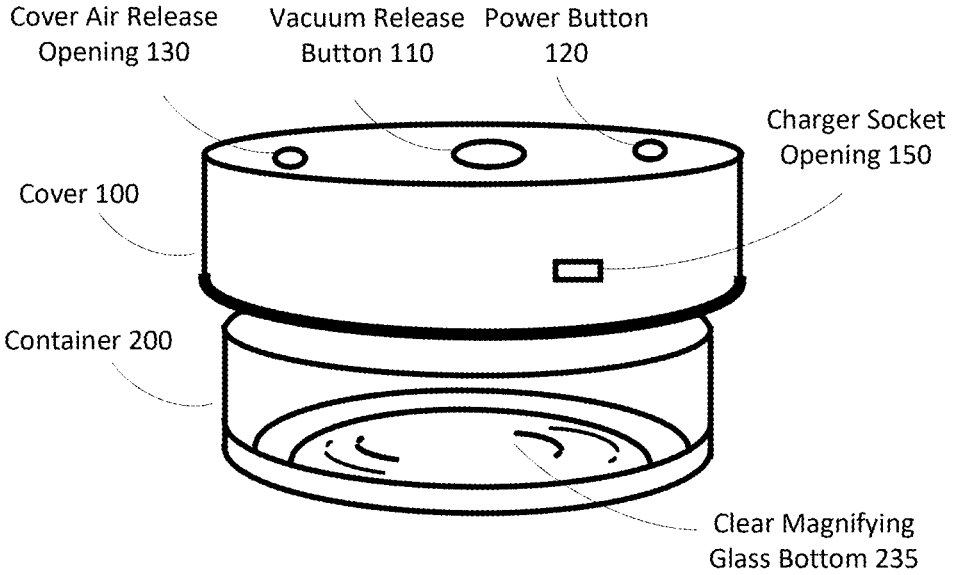
FIG. 6B is a diagram of an exemplary device for perishables preservation, wherein the shown device includes a clear glass container having a magnifying glass bottom, in accordance with some embodiments.

Reference is now made to FIG. 6B, where there is shown a diagram of an exemplary device for perishables preservation (10), wherein the shown device includes a clear glass container (200) having a magnifying glass bottom (235), facilitating a magnified view of the container's (200) content by the user, without its opening.

Figure 7:
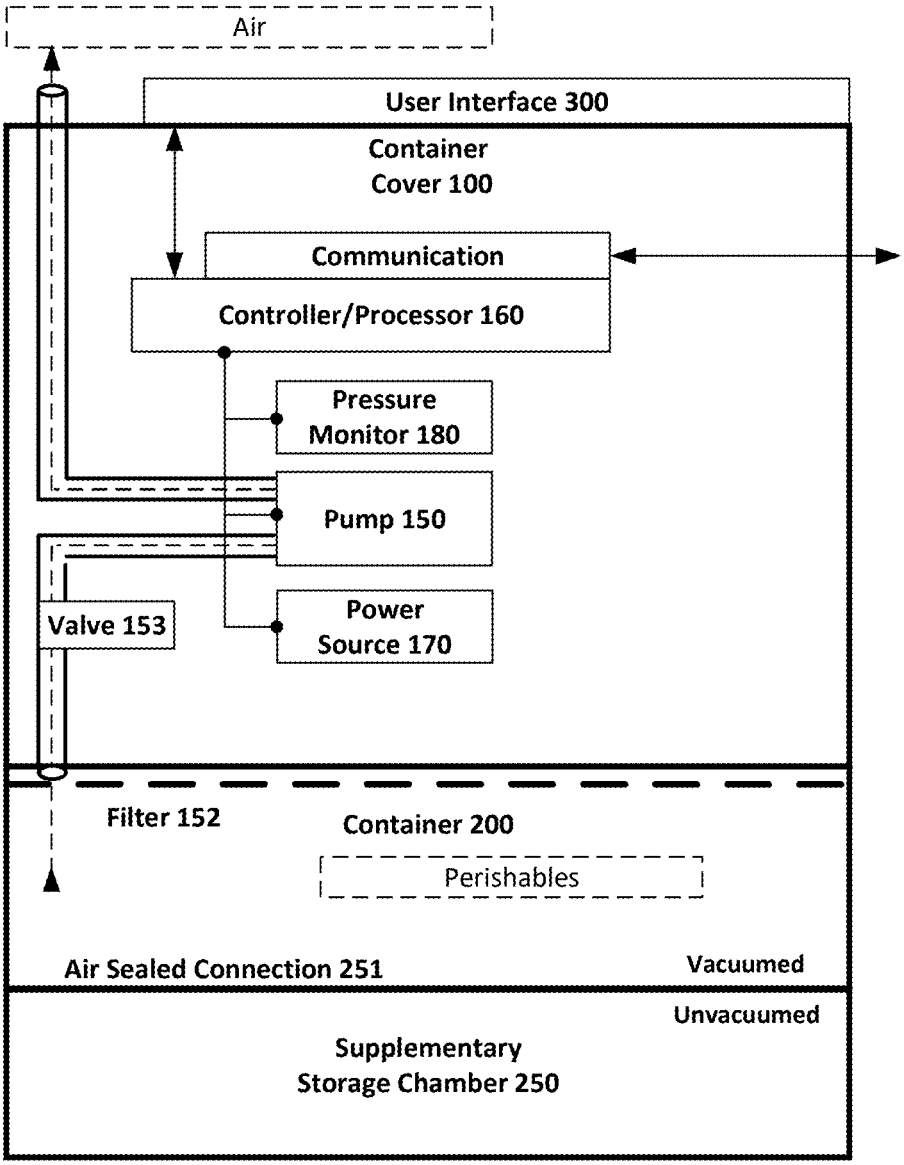
FIG. 7 is a diagram of an exemplary device for perishables preservation, wherein the shown device includes a supplementary storage chamber, in accordance with some embodiments.

Reference is now made to FIG. 7, where there is shown a diagram of an exemplary device for perishables preservation (10), wherein the shown device includes a supplementary storage chamber (250), in accordance with some embodiments. The supplementary storage chamber (250) is shown to be connected to the bottom of the device container (200). The connection between the supplementary storage chamber (250) and the container (200) may be an air sealed connection (251) as shown and, may take the form of a screwing connection, a lever connection, a snap-grip(s) connection, or other. The supplementary storage chamber (250) may be unvacuumed, as shown; or, may be connected to the main vacuum generation components of the device (10) in the cover (200), or may include its own vacuum generation components as described herein.

Figure 8:
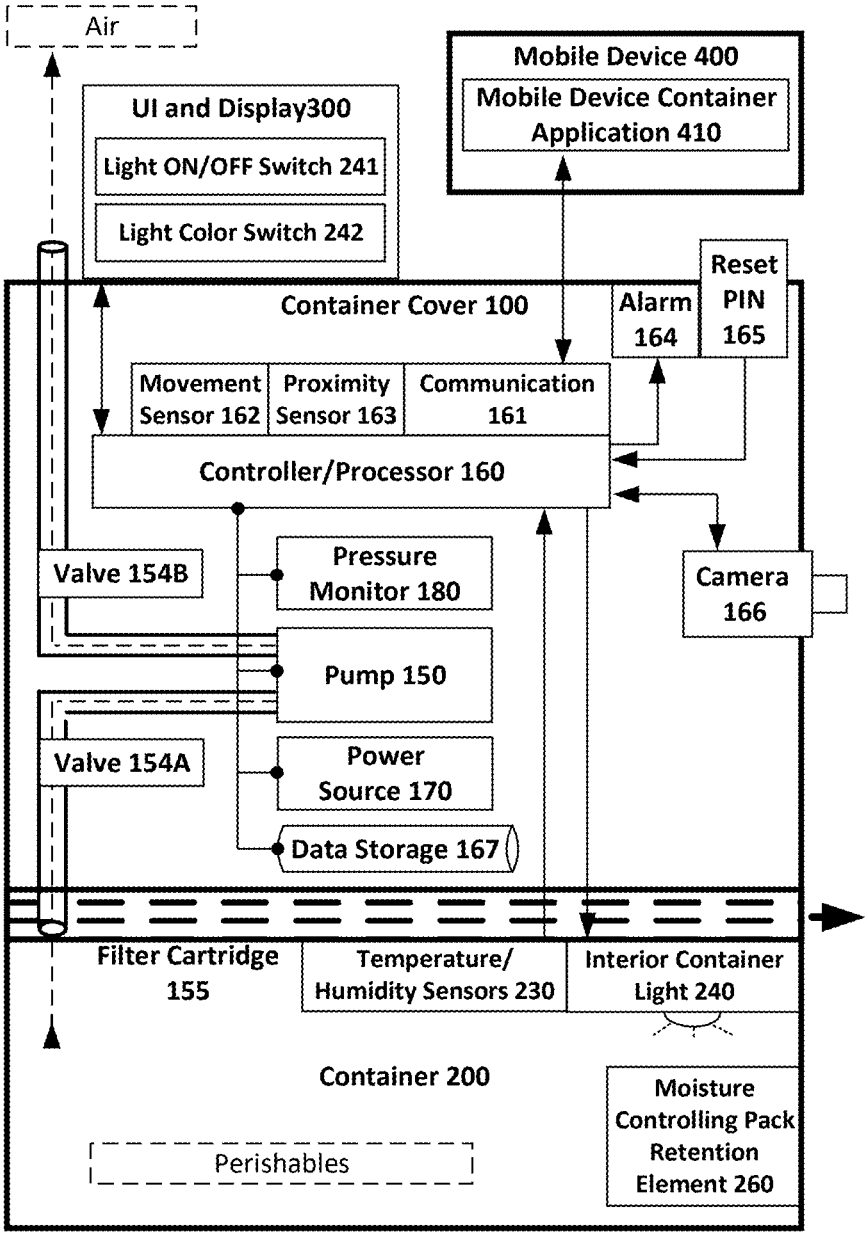
FIG. 8 is a diagram of an exemplary device for perishables preservation, wherein the shown device includes pump entry and exit valve filters, a container cover filter cartridge, a digital display, an interior light having an ON/OFF switch and a color switch, a reset pin, a movement sensor and alarm, an application proximity alarm, and temperature and humidity sensors and alarms, in accordance with some embodiments.

Reference is now made to FIG. 8, where there is shown a diagram of an exemplary device for perishables preservation (10), wherein the shown device includes pump entry and exit valve filters (154A, 154B), a container cover filter cartridge (155), a user interface and digital display (300), an interior light (240), a reset pin (165), a movement sensor (162) and alarm (164), an application/device proximity sensor (163) and alarm (164), and temperature and humidity sensors (230) and alarm (164), in accordance with some embodiments.

The valve filters (154A, 154B) are shown to be positioned over/on the air channel entering, and the air channel exiting the pump (150), respectfully. The filter cartridge (155) is shown to include multiple filtering layers, and, may be removed from within the container cover (100), for example, by being pulled out of its slot in the direction of the thick right pointing arrow, and replaced.

The interior light (240), controlled through the light ON/OFF switch (241) of the user interface and digital display (300), is used to light the interior of the container (200), enabling the viewing of the stored perishables. According to some embodiments, the interior light (240) may include several bulbs, LEDs, or LED diodes to generate light of different colors (e.g. white, red, green, blue, purple) based on user selection made through the shown light color switch (242), or through the mobile device container application (420).

The shown reset pin (165) may be used to restore some or all of the device's (10) factory settings, for example, the reset pin (165) may be used to reset and open a vacuum-locked device (10) as described herein, necessitating a code/password/PIN for releasing the vacuum and opening the device (10), for which the user has lost/forgotten the code/password/PIN. According to some embodiments, the reset pin (165) may be positioned within the container (200), such that a user who has lost/forgotten the code/password/PIN may receive (e.g. from a system support platform/agent) an OTP to open the container cover (100) once, access the reset pin (165) within the container (200) and use it to reset his code/password/PIN for future use.

The shown movement sensor (162) may trigger the alarm (164) upon the container being moved from its static position. The temperature and humidity sensors (230) may trigger the alarm (164) upon humidity level and/or temperature within the container (200) rising above, or falling under, respective threshold levels. The motion/movement, proximity, temperature, humidity, and/or any other sensor triggered alarm, may be: any device (10) alarm—such as an acoustic (e.g. voice, sound, beep), a visual (e.g. display, light bulb), and/or a tactile (e.g. vibration); any mobile device (400) alarm or notification triggered by the mobile device application (410); and/or any combination thereof.

The application/device proximity sensor (163) may automatically trigger a vacuum generation cycle as described herein to generate the vacuum within and prevent/disable the opening of a specific vacuum-locked device (10), upon a mobile device (400) having an installed mobile device application (410) associated with that specific device, exiting the specific device's (10) proximity. For example, the mobile device application (410) may intermittently attempt to establish connection with the communication module (161) of its associated device (10), using a short-range limited communication protocol/method (e.g. Bluetooth, NFC). As the user, along with his mobile device (400) and application (410), exits the associated device's (10) proximity, the connection may fail (i.e. after successful attempts) indicating the loss of proximity and triggering the vacuum generation cycle and locking.

The application/device proximity sensor (163) may automatically trigger a vacuum release cycle as described herein to release the vacuum within and enable the opening of a specific vacuum-locked device (10), upon a mobile device (400) having an installed mobile device application (410) associated with that specific device, entering the specific device's proximity (10). For example, the mobile device application (410) may intermittently attempt to establish connection with the communication module (161) of its associated device (10), using a short-range limited communication protocol/method (e.g. Bluetooth, NFC). As the user, along with his mobile device (400) and application (410), enters the associated device's (10) proximity, the connection may be finally established (i.e. after failed attempts) indicating the proximity and triggering the vacuum release cycle.

The shown moisture controlling pack retention element (260) may for example take the form of a box, cage, slot or clip—to position moisture controlling pack(s) at a preferred location for optimal effect and easy container content access.

According to some embodiments of the present invention, a device for perishables preservation may include: a container; and a cover comprising: a battery powered air pump to drive air from within the container to its external environment to generate partial vacuum within the container; a container pressure sensor to measure the pressure within the container; and a pressure monitoring and regulation controller configured to stop the operation of the battery powered air pump once a target pressure level in the container is indicated by the container pressure sensor.

According to some embodiments, the cover may further comprise a cover engagement sensor to signal to the pressure monitoring and regulation controller upon closing of the cover over a corresponding opening of the container; and wherein the controller, in response, initiates the operation of the air pump.

According to some embodiments, the device may further comprise a pressure release mechanism, on the cover, which when pressed or engaged allows air to flow into the container's chamber through a valve.

According to some embodiments, the pressure release mechanism, when pressed or engaged, may be further adapted to suppress gas pumping by the pressure monitoring and regulation controller.

According to some embodiments, the pressure release mechanism may take the form of an electric mechanism comprising a digital interface, or a communication module or circuitry, to receive and relay an entered code to the pressure monitoring and regulation controller, and wherein the controller verifies the entered code prior to electrically engaging the valve and/or releasing a mechanical control that prevents the valve from being manually released.

According to some embodiments, the pressure monitoring and regulation controller may implement an OTP (One Time Password) scheme by utilizing the unique serial number of the device, a unique key, and a one-way authentication function based on Hash chains.

According to some embodiments the device may further include: an interior light, including two or more LED diodes of different colors, positioned on a bottom, container facing, section of the cover; and a light color switch for selectively operating a subset of the two or more LED diodes of different colors.

According to some embodiments, the container may be made out of clear glass having a magnifying glass bottom.

According to some embodiments the cover may comprise one or more filtering layers, positioned across its bottom side to, at least partially, cover the container's top opening, such that air pumped out of the container by the pump is pulled through the filtering layers, prior to its release to the outside environment.

According to some embodiments, the one or more filtering layers may include a carbon filter layer and may be collectively retained within a replaceable cartridge.

According to some embodiments, the device may further comprise: a first valve, having a filter core, at the path of the air entering the battery powered pump; and a second valve, having a filter core, at the path of the air exiting the battery powered pump.

According to some embodiments, the filter core may include a high-density cotton or a carbon filtering element.

According to some embodiments, the container may further include an additional adjacent non-vacuumed chamber.

According to some embodiments, the container may further include a humidity sensor, wherein the controller is adapted to engage the pump upon the humidity sensor indicating a humidity above a predetermined level within the container.

According to some embodiments, the device may be further adapted to provide a notification upon the humidity sensor indicating a humidity above a predetermined level within the container.

According to some embodiments, the container may further include a temperature sensor, wherein the controller is adapted to engage the pump upon the temperature sensor indicating a temperature above a predetermined level within the container.

According to some embodiments, the device may be further adapted to provide a notification upon the temperature sensor indicating a temperature above a predetermined level within the container.

According to some embodiments, the device may further include a divider insertable component for partitioning the container's internal space to store multiple kinds or types of perishables separately and distinctly; and the cover may further include a user interface and a digital display, wherein the user interface is adapted to input and present content labels corresponding to and identifying the type or kind of perishable stored within each of the container's sectors.

According to some embodiments of the present invention, a system for perishables preservation may include: a computerized device application; and a device including: a container; and a cover comprising: a battery powered air pump to drive air from within the container to its external environment to generate partial vacuum within the container; a container pressure sensor to measure the pressure within the container; a pressure monitoring and regulation controller configured to stop the operation of the battery powered air pump once a target pressure level in the container is indicated by the container pressure sensor; a pressure release mechanism to allow air to flow into the container's chamber through a valve, the mechanism comprising a communication module or circuitry to receive a code communicated by the computerized device application and relay the communicated code to the pressure monitoring and regulation controller; and, wherein the controller verifies the communicated code, prior to engaging the pressure release mechanism.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

The invention claimed is:

1. A device for perishables preservation, said device including:

a container; and a cover comprising:

a battery powered air pump to drive air from within said container to its external environment to generate partial vacuum within said container;

a container pressure sensor to measure the pressure within said container;

a pressure monitoring and regulation controller configured to stop the operation of said battery powered air pump once a target pressure level in said container is indicated by said container pressure sensor; and a pressure release mechanism on said cover which when pressed or engaged allows air to flow into said container's chamber through a valve, wherein said pressure release mechanism is an electric mechanism comprising a digital interface, or a communication module or circuitry, to receive and relay an entered code to said pressure monitoring and regulation controller, and wherein said controller verifies the entered code prior to electrically engaging said valve.

2. The device according to claim 1, wherein said cover further comprises a cover engagement sensor to signal to said pressure monitoring and regulation controller upon closing of said cover over a corresponding opening of said container; and wherein said controller, in response, initiates the operation of said air pump.

3. The device according to claim 1, wherein said pressure release mechanism, when pressed or engaged, is further adapted to suppress gas pumping by said pressure monitoring and regulation controller.

4. The device according to claim 1, wherein said pressure monitoring and regulation controller implements an OTP (One Time Password) scheme by utilizing the unique serial number of the device and a one way authentication function based on Hash chains.

5. The device according to claim 1, further including:

an interior light, including two or more LED diodes of different colors, positioned on a bottom, container facing, section of said cover; and a light color switch for selectively operating a subset of the two or more LED diodes of different colors.

6. The device according to claim 1, wherein said container is made of clear glass and comprises a magnifying glass bottom.

7. The device according to claim 1, further comprising:

a first valve, having a filter core, at the path of the air entering said battery powered pump; and a second valve, having a filter core, at the path of the air exiting said battery powered pump.

8. The device according to claim 7, wherein said filter core includes a high-density cotton or a carbon filtering element.

9. The device according to claim 1, wherein said container further includes an additional adjacent non-vacuumed chamber.

10. The device according to claim 1, wherein said container further includes a humidity sensor and wherein said controller is adapted to engage said pump upon said humidity sensor indicating a humidity above a predetermined level within said container.

11. The device according to claim 10, further adapted to provide a notification upon said humidity sensor indicating a humidity above a predetermined level within said container.

12. The device according to claim 1, wherein said container further includes a temperature sensor and wherein said controller is adapted to engage said pump upon said temperature sensor indicating a temperature above a predetermined level within said container.

13. The device according to claim 12, further adapted to provide a notification upon said temperature sensor indicating a temperature above a predetermined level within said container.

14. The device according to claim 1 further including a divider insertable component for partitioning said container's internal space to store multiple kinds or types of perishables separately and distinctly;

said cover further includes a user interface and a digital display, and wherein said user interface is adapted to input and present content labels corresponding to and identifying the type or kind of perishable stored within each of said container's sectors.

15. A device for perishables preservation, said device including:

a container; and a cover comprising:

a battery powered air pump to drive air from within said container to its external environment to generate partial vacuum within said container;

a container pressure sensor to measure the pressure within said container;

a pressure monitoring and regulation controller configured to stop the operation of said battery powered air pump once a target pressure level in said container is indicated by said container pressure sensor; and wherein said cover further comprises one or more filtering layers, positioned across its bottom side to, at least partially, cover the container's top opening, such that air pumped out of the container by said air pump is pulled through said filtering layers, prior to its release to the outside environment.

16. The device according to claim 15, wherein said one or more filtering layers include a carbon filter layer and are collectively retained within a replaceable cartridge.

17. A system for perishables preservation, said system including:

a computerized device application; and a device including:

a container; and a cover comprising:

a battery powered air pump to drive air from within said container to its external environment to generate partial vacuum within said container;

a container pressure sensor to measure the pressure within said container;

a pressure monitoring and regulation controller configured to stop the operation of said battery powered air pump once a target pressure level in said container is indicated by said container pressure sensor;

a pressure release mechanism to allow air to flow into said container's chamber through a valve, said mechanism comprising a communication module or circuitry to receive a code communicated by said computerized device application and relay the communicated code to said pressure monitoring and regulation controller; and wherein said controller verifies the communicated code, prior to engaging said pressure release mechanism.

* * * * *